US010941735B2

(12) United States Patent
Halleron et al.

(10) Patent No.: US 10,941,735 B2
(45) **Date of Patent: *Mar. 9, 2021**

(54) METHODS AND SYSTEMS FOR AN EXHAUST-GAS RECIRCULATION VALVE

(71) Applicant: Ford Global Technologies, LLC, Dearborn, MI (US)

(72) Inventors: Ian Halleron, Chelmsford (GB); Zoltan Szilagyi, Budapest (HU); Jon Dixon, Maldon (GB)

(73) Assignee: Ford Global Technologies, LLC, Dearborn, MI (US)

( * ) Notice: Subject to any disclaimer, the term of this patent is extended or adjusted under 35 U.S.C. 154(b) by 114 days.

This patent is subject to a terminal disclaimer.

(21) Appl. No.: 16/252,175

(22) Filed: Jan. 18, 2019

(65) Prior Publication Data

US 2019/0226430 A1 Jul. 25, 2019

(30) Foreign Application Priority Data

Jan. 22, 2018 (GB) ..... 1801026

(51) Int. Cl.
*F02M 26/00* (2016.01)
*F02M 26/49* (2016.01)

(52) U.S. Cl.
CPC ..... *F02M 26/49* (2016.02); *F02M 2026/001* (2016.02)

(58) Field of Classification Search
CPC .. F02M 216/48; F02M 216/49; F02M 216/52; F02M 2026/001; F02D 41/0077; F02D 41/26; F02D 2200/02; F02D 21/08
See application file for complete search history.

(56) References Cited

U.S. PATENT DOCUMENTS 5,201,303 A 4/1993 Kojima
6,374,813 B1 * 4/2002 Iida ..... F01L 9/04 123/568.14
2002/0100462 A1 * 8/2002 Yang ..... F02D 41/0077 123/568.16
2003/0139873 A1 7/2003 Birkner et al.
(Continued)

FOREIGN PATENT DOCUMENTS

EP 0837237 A2 4/1998
EP 3101254 A1 12/2016
JP 2007092684 A 4/2007
(Continued)

OTHER PUBLICATIONS

Great Britain Intellectual Property Office, Combined Search and Examination Report under Section 17 and 18(3), dated Jul. 20, 2018, 6 pages.
(Continued)

*Primary Examiner* — Phutthiwat Wongwian
*Assistant Examiner* — Sherman D Manley
(74) *Attorney, Agent, or Firm* — Geoffrey Brumbaugh; McCoy Russell LLP

(57) ABSTRACT

Methods and systems are provided for adjusting an EGR valve operation based on results from an EGR valve diagnostic. In one example, a method may include executing the EGR valve diagnostic during an engine deactivation, wherein the EGR valve diagnostic estimates an EGR valve stickiness used to adjust the EGR valve operation.

20 Claims, 10 Drawing Sheets

(56) References Cited

U.S. PATENT DOCUMENTS

2019/0226429 A1* 7/2019 Halleron ..... F02M 26/49

FOREIGN PATENT DOCUMENTS

| | | | |
|---|---|---|---|
| JP | 2008063964 | A | 3/2008 |
| KR | 20150071238 | A | 6/2015 |
| WO | 2011117108 | A1 | 9/2011 |

OTHER PUBLICATIONS

Halleron, I. et al., "Methods and Systems for EGR Valve Diagnostics," U.S. Appl. No. 16/245,866, filed Jan. 11, 2019, 55 pages.

* cited by examiner

METHODS AND SYSTEMS FOR AN EXHAUST-GAS RECIRCULATION VALVE

CROSS REFERENCE TO RELATED APPLICATION

This application claims priority to Great Britain Patent Application No. 1801026.4, filed Jan. 22, 2018. The entire contents of the above-referenced application are hereby incorporated by reference in their entirety for all purposes.

FIELD

The present description relates generally to adjustments to an exhaust-gas recirculation (EGR) valve in response to an estimated contamination of the valve.

BACKGROUND/SUMMARY

EGR valves may be used in engines to recirculate part of the exhaust gas back into the internal combustion chamber of the engine. This has the benefit of lowering the emissions of the engine and therefore lowering the emissions of the vehicle in which the engine is situated, since the presence of exhaust gas dilutes the oxygen percentage in the incoming air stream with gases inert to combustion which therefore absorb heat. This may have the effect of lowering the engine temperature and therefore reducing the amount of NOx gases generated, since NOx gases are generated when nitrogen and oxygen are subject to high engine temperatures.

As EGR valves recirculate exhaust gas they may be prone accumulating carbon deposits and other particulates in the exhaust gas that can hamper, or prevent, the valves from opening. Without treatment (e.g. cleaning or other maintenance) this can eventually lead to the EGR valve sticking closed, fully open, or partially open. For example, EGR valves of the poppet design can suffer from contamination of the valve stem which, as above, can lead eventually to the valve sticking closed, fully open, or partially open. Before EGR valves become fully stuck they may exhibit slow movement demanding large control effort (e.g., energy) and may exhibit jerky "stick-slip" motion. This can result in too much or too little exhaust gas flowing, which can lead to undesirable engine operations including increased engine-out emissions, combustion instability, inefficient engine starting, overheating of engine components, etc.

If this is detected by the diagnostic elements of the engine control system then this may result in a reduction in the engine power, or even the engine being disabled. Consequently, the vehicle may demand a visit to a repair facility, which may include replacement of the EGR valve depending on a magnitude of the contamination.

EGR valve contamination may be caused by, for example, the condensation of hydrocarbons and water and the accumulation of soot onto the EGR valve stem, which may be exacerbated at low temperatures. Increased usage of EGR valves at low temperatures due to more stringent emissions standards may be more likely to increase the risk of the above described type of "cold fouling" and/or "cold contamination" of the EGR valve.

In one example, the issues described above may be addressed by a method comprising executing an EGR valve diagnostic following an engine deactivation to adjust an EGR valve operation, wherein the EGR valve diagnostic calculates three or more of a breakaway value, a holding power value, a hang time value, a travel time value, and a travel speed value as an EGR valve is actuated from a resting position, to a predetermined position, and back to the resting position. In this way, EGR valve operation may be adjusted to compensate for ageing and valve contamination, which may increase an accuracy of EGR valve positioning.

As one example, an EGR valve operation may be affected by EGR valve contamination, ageing, aerodynamics, and other external factors. An actuator may move an EGR valve to a position based on a signal from a controller, however, due to the mentioned factors, the position may be different than a desired position. If this occurs, engine efficiency may decrease and emissions may increase. Thus, it may be desired to improve the EGR valve position by adjusting its operation in response to a valve stickiness estimated during an EGR valve diagnostic, which may measure static friction when the valve opens, sliding friction as the valve closes, and an ageing of a return spring.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
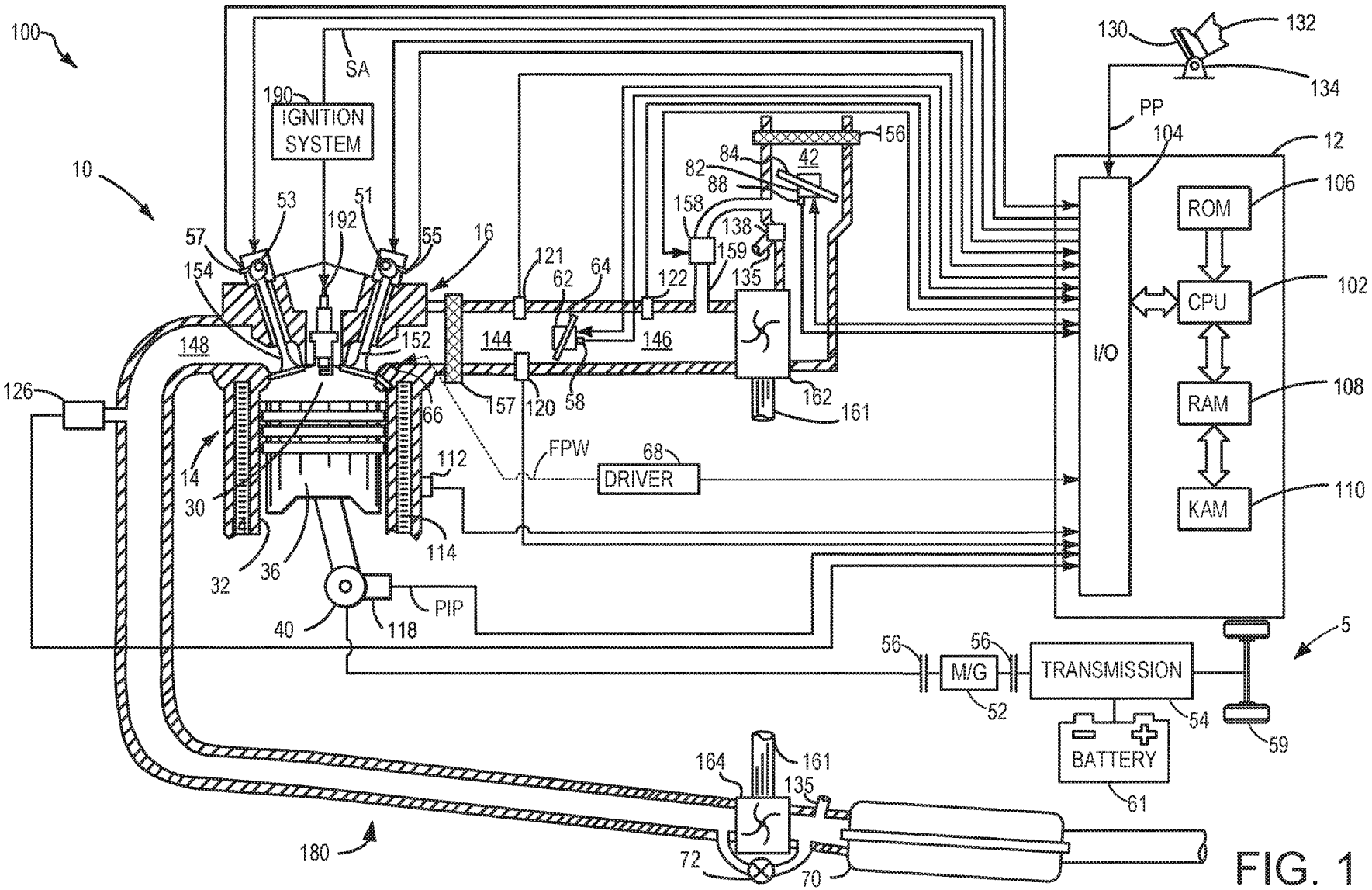
FIG. 1 illustrates a schematic of an engine included in a hybrid vehicle.

The following description relates to systems and methods for adjusting EGR valve operation in response to an estimated contamination of the EGR valve. The EGR valve may be configured to direct exhaust gases into an intake passage, as shown in FIG. 1. The estimated contamination may be reflective of a stickiness value determined by a diagnostic method shown in FIG. 4. Entry conditions for the diagnostic method may be determined in methods shown in FIGS. 5 and 7. A chart shown in FIG. 6 illustrates methods occurring prior to the method of FIG. 4.

Figure 2:
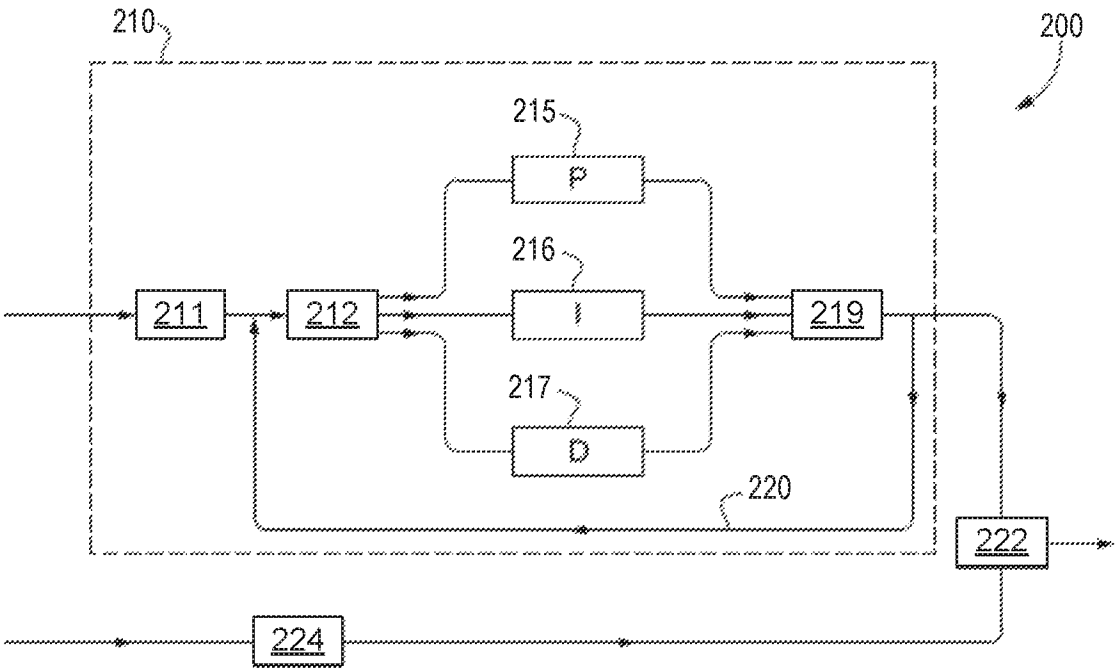
FIG. 2 illustrates a system for adjusting a position of an EGR valve.
Figure 3:
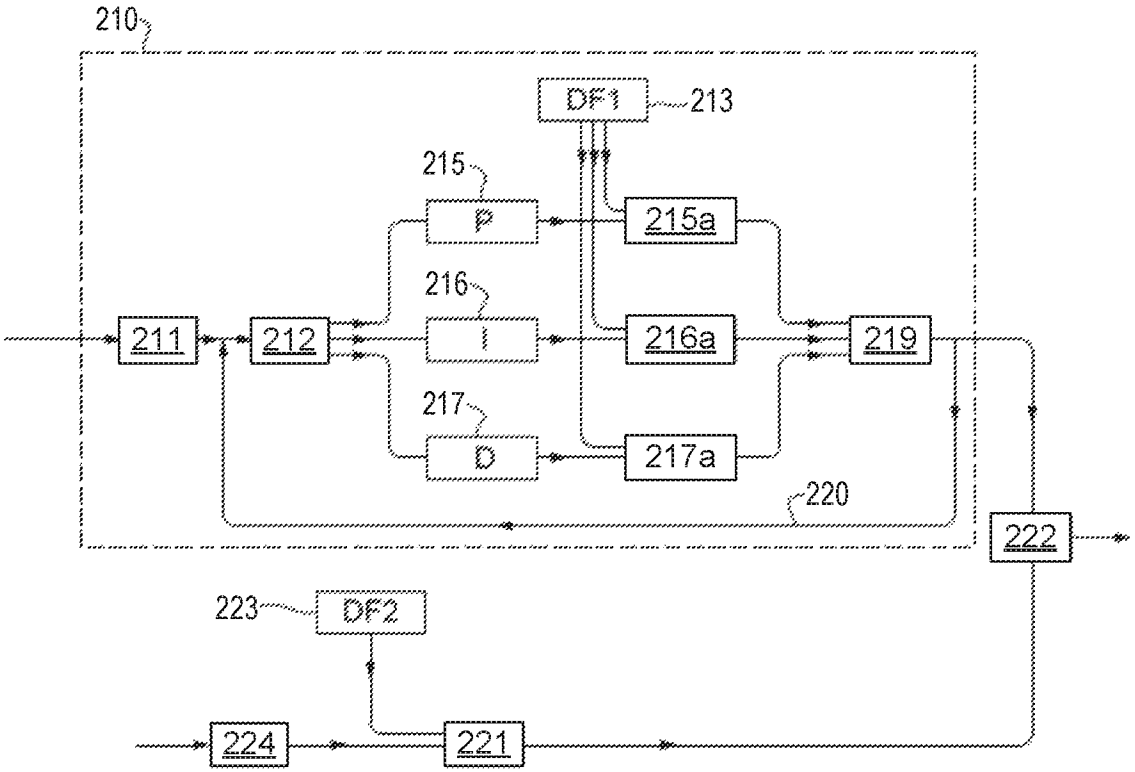
FIG. 3 illustrates the system shown in FIG. 2 in greater detail.
Figure 8:
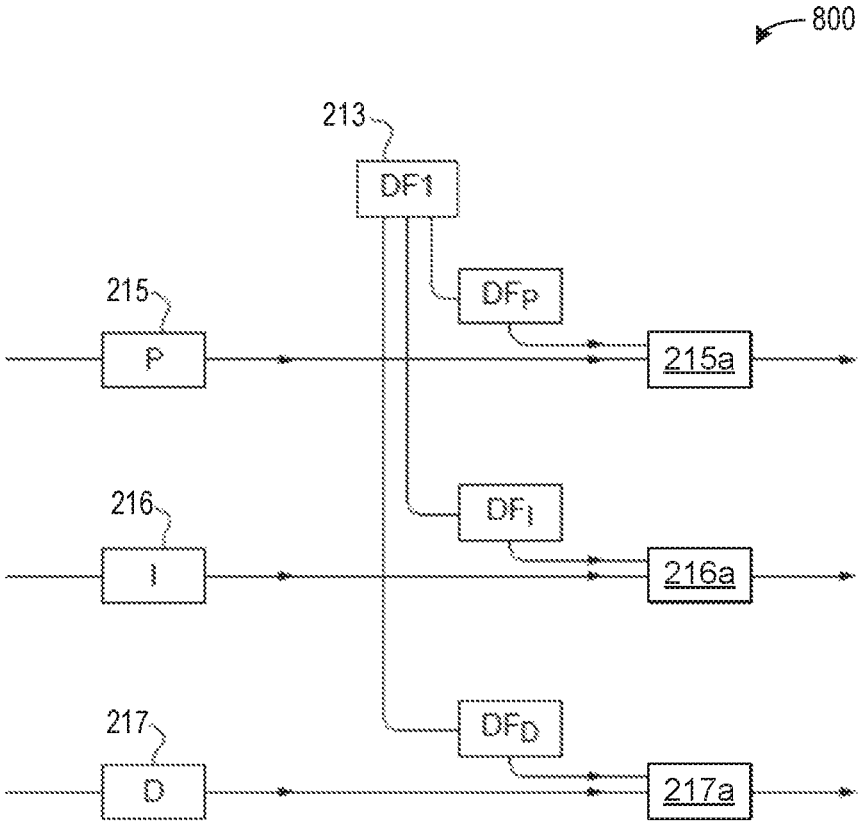
FIG. 8 illustrates a diagram for adjusting the gains of a controller based on a valve stickiness factor estimated from the EGR valve diagnostic.
Figure 9:
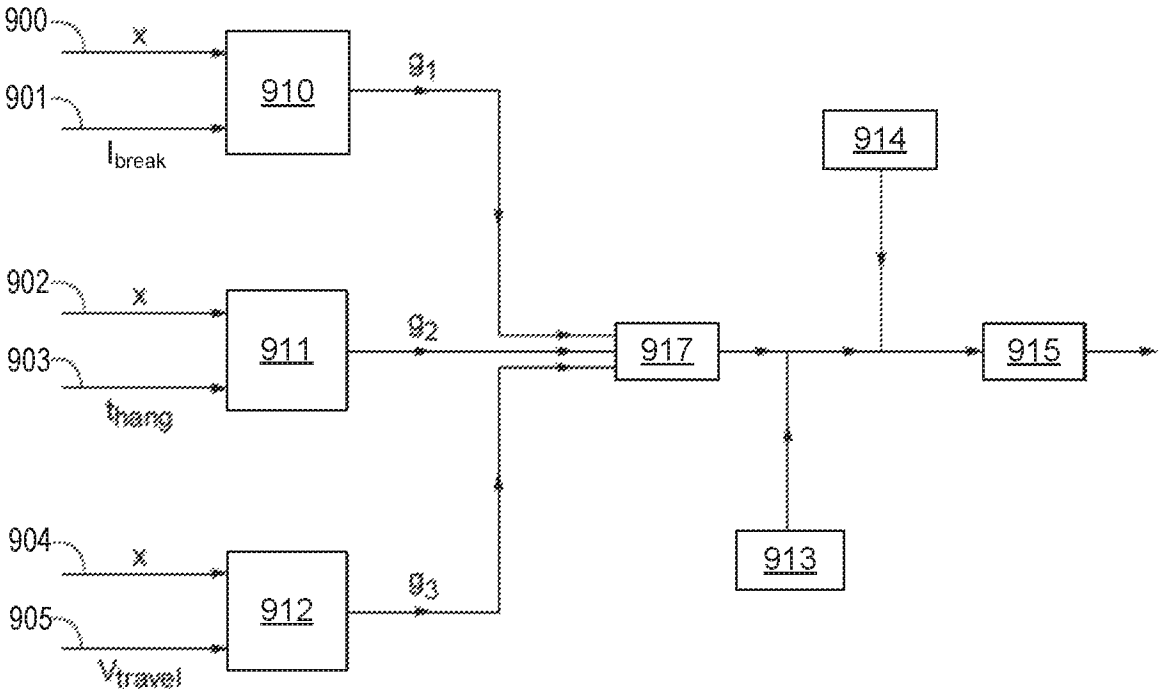
FIG. 9 illustrates a diagram for adjusting a feed-forward term of the controller based on a valve stickiness factor estimated from the EGR valve diagnostic.

The stickiness value, along with other factors such as aerodynamics, may be used to adjust the EGR valve operation. A system for adjusting the EGR valve position is shown in FIGS. 2 and 3. Methods for using one or more factors, included within the stickiness value, for adjusting the EGR valve operation are shown in FIGS. 8 and 9.

FIG. 1 shows an example configuration with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

The present disclosure provides a diagnostic method to detect early onset of EGR valve contamination or fouling and accordingly to adjust subsequent EGR valve operation based on the contamination and/or fouling.

According to the present disclosure there is provided an exhaust gas recirculation (EGR) valve diagnostic method, the method comprising setting the power supplied to an EGR valve actuator to zero, increasing the power supplied to the EGR valve actuator, determining the power needed to open the EGR valve, actuating the EGR valve to move the EGR valve to a predetermined open position, setting the power supplied to the EGR valve actuator to zero, and at least one of determining the time between the setting the power supplied to the EGR valve actuator to zero and the start of the EGR valve movement towards the closed position and/or a resting position and determining the time taken for the EGR valve to travel to within a set distance from the closed position, which may correspond to the resting position, of the EGR valve.

Additionally or alternatively, the speed at which the EGR valve travels from the predetermined open position to the resting position may be estimated. An EGR valve operation may be adjusted following the EGR valve diagnostic during a subsequent engine operation where the engine is combusting (e.g., activated).

The degree to which the valve is opened may be selected so that a force of the return spring will not dominate the dynamics. The force of the return spring may increase as the EGR valve is moved further toward the fully open position due to the return spring elongating and/or compressing. As such, the predetermined open position may be selected based on a position where a power used to open the EGR valve is relatively low and where the return spring may force the valve closed in response to an absence of power supplied to a valve actuator. Accordingly, the predetermined open position of the valve may be a partially open position substantially equal to 30% of the fully open position. That is to say, the predetermined open position may more closely resemble the fully closed position compared to the fully open position. As such, the partially open position of 30% or greater of the fully open position may mitigate an impact of the return spring on the breakaway power, but also provide sufficient travel time of the valve during closing to permit measurements.

The power used to hold the EGR valve at this position, herein referred to as the "holding power" may be indicative of the condition of the return spring on the valve. The power used to move the EGR valve, herein referred to as the "breakaway power", and the time taken before the EGR valves moves toward its closed position following removal of the holding power, herein referred to as the "hang time", may be indicative of the static friction experienced by the valve at its rest position (e.g., the fully closed position where power may not be supplied to the valve actuator of the EGR valve). A speed at which the EGR valve travels from the predetermined open position to the resting position may be referred to as the "valve speed." It may be an average speed (e.g., in units of percentage per second) at which the valve travels from the predetermined position to the resting position. Valve speed may be more applicable than travel time as it may be more directly comparable across different travel distances of the EGR valve. However, travel time may still be used without departing from the scope of the present disclosure.

Measuring the breakaway power, hang time, holding power, and travel speed, and using them to calculate a diagnostic factor may allow for improved operation of the EGR valve. For example, the breakaway power and hang time may be indicative of the static friction experienced by the valve at its rest positions while the valve speed (which can also be referred to as "drop speed") may be indicative of the sliding friction. The holding power may be indicative of the condition of the return spring. These measurements, either alone or in combination, may provide an indication of the level of valve contamination and ageing. Thus, the present disclosure utilizes this indication of contamination or ageing in a valve position controller.

As will be expanded upon below, the diagnostic factor may be used to calculate additional corrections to a PID controller parameters and to a feed-forward term used in an EGR valve controller.

The EGR valve diagnostic factor may be selected to be at least one of the breakaway power, the holding power; the hang time, the travel time; and the valve speed.

The EGR valve diagnostic factor may be selected to be a function of at least one of the breakaway power, the holding power; the hang time, the travel time; and the valve speed.

The function may be the output of a look-up table with the input(s) being equal to the breakaway power, the holding power; the hang time, the travel time; and the valve speed. At least one of the functions may be a polynomial. For example, at least one of the functions may be linear.

The EGR valve diagnostic factor may be selected to be a function of the direction of movement of the EGR valve and at least one of the breakaway power, the holding power, the hang time, the travel time, and the valve speed.

The function may be the output of a look-up table with direction of movement of the EGR valve and the variable(s) being at least one of the breakaway power, the holding power, the hang time, the travel time, and the valve speed as its inputs. At least one of the functions may be a polynomial.

The EGR valve diagnostic factor may be selected to be at least one of the average breakaway power, the average holding power, the average hang time, the average travel time, and the average valve speed.

The EGR valve diagnostic factor may be selected to be a function of at least one of the average breakaway power, the average holding power, the average hang time, the average travel time, and the average valve speed.

The function may be the output of a look-up table with the variable(s) being at least one of the breakaway power, the holding power, the hang time, the travel time, and the valve speed as its input(s). At least one of the functions may be polynomial, for example at least one of the functions may be linear.

The EGR valve diagnostic factor may be selected to be the maximum value of the function of the average breakaway power, the function of the average holding power, the function of the average hang time, the function of the average travel time, and the function of the average valve speed.

The EGR valve may be controlled by a PID (Proportional-Integral-Derivative) controller. The step of adjusting the control of the EGR valve may comprise multiplying or adding the output of the PID controller by a first diagnostic factor. The PID controller may have a feed-forward term correction. The step of adjusting control of the EGR valve may, in the alternative or in addition, comprise multiplying or adding the feed-forward term by a second diagnostic factor.

Controlling the position of the EGR valve with a PID controller with a feed-forward correction allows the position of the EGR valve to be more accurately known. For example, the controller gains (proportional P, integral I, and derivative D) may be calculated as functions of the position deviation (the actual position subtracted from the desired position) with corrections for the gas mass flow through the valve, the pressure difference across the valve, the engine operating mode and speed, the engine temperature, and the air temperature.

A feed-forward term is also calculated which can depend on at least one of the position deviation with corrections for the gas mass flow through the valve, the pressure difference across the valve, the engine operating mode and speed. This feed-forward term can be added to the output of the PID controller. Adding a feed-forward term that depends on gas mass flow through and pressure difference across the EGR valve represents adding an aerodynamic correction. Such an aerodynamic correction may be added to the feed-forward term itself, or may be added together or separately to the output of the PID controller.

In this way, aerodynamic and environmental operating conditions experienced by the EGR valve, in addition to the position error, are considered in the selection of the controller parameters of the EGR valve which have a large influence on the response time, accuracy and stability of the controller. Accurate control of EGR flow may allow for desired control of NOx feedgas from the engine. The disclosure improves upon this accuracy by taking into account the varying condition of the EGR valve over its lifetime.

For example, during use, deposits may form from combinations of hydrocarbons, soot, and condensed water on the moving parts of the EGR valve which may alter its response to a driving power. For example, deposits may form on the valve stem and stem seal of a poppet-type valve which may slow the valve or cause it to stick in the open, partially open or closed positions. The present disclosure utilizes these factors to adjust EGR operation to during subsequent engine operating conditions.

Exemplified above are types of diagnostic factors. It will be apparent that the diagnostic factor for the PID controller may not be the same as the diagnostic factor for the feed forward term correction. As above, the factor may be a suitable value, a suitable average, or a suitable function of a suitable value or average). The diagnostic factor may also be a function of a function of one of these valves.

The engine operating state, aerodynamic and environmental conditions may also be taken into account in the feed-forward term or PID controller output.

According to the present disclosure there is also provided a system for controlling an EGR valve comprising a controller configured to perform the method described herein.

According to the present disclosure there is also provided a computer-readable medium and/or a controller comprising instructions which, when executed enable the controller to execute adjustments for the EGR valve operation.

Herein, where a "function" is referred to it will be understood that such function could be an identity function.

The time taken for the EGR valve to travel to within a set distance from the closed position of the EGR valve may give an indication of contamination of the valve. By monitoring the time taken for the valve to move it can be determined if the valve is contaminated to such a degree that valve movement is impaired. The valve may still be operational, but its operation may be less than a desired threshold, and so the diagnostic method can diagnose and compensate for valve contamination.

Similarly, if it is determined that at least one of the power supplied to the EGR valve actuator to cause it to open, the power needed to hold the EGR valve in the predetermined open position, the time between the setting the power supplied to the EGR valve actuator to zero and the start of the EGR valve movement towards the closed position, the time taken for the EGR valve to travel to within a set distance from the closed position (as above), and/or the speed of the valve when travelling from its predetermined open position to within the set distance from its closed position, does not fall within a predetermined range then this can indicate partial contamination and EGR valve operation may be adjusted.

For example, if one or more of the power supplied to open the EGR valve, the power needed to hold the EGR valve in the predetermined open position, the time between setting the power supplied to the EGR valve actuator to zero and the start of the EGR valve movement towards the closed position, and the time taken for the EGR valve to travel to within a set distance from the closed position is above a predetermined threshold, then adjustments to an EGR valve operation may be desired. Additionally or alternatively, if the speed of the valve when travelling from its predetermined open position to within the set distance from its closed position is below a predetermined threshold, then adjustments to the EGR valve operation may be desired.

The diagnostic method may begin with setting the power to the EGR valve actuator to zero which may occur after the engine has stopped and/or been deactivated. The valve may still be warm, but there is no exhaust gas recirculation following the engine deactivating. The method may continue by partially opening the valve by supplying some amount of power to a valve actuator so that the EGR valve may move from a fully closed position to a partially open position. The fully closed position may correspond to a position of the EGR valve where exhaust gas may not flow from an EGR passage to an engine. As such, an EGR flow rate may be substantially equal to zero when the EGR valve is fully closed. The method may further include removing the power to the valve actuator so that the EGR valve returns to the fully closed position or to a more closed position. Calculations may be performed to determine the time the valve remains in the partially open position before falling back to the fully closed or more closed positions and the time the valve takes to move from the partially open position to the fully closed or more closed positions. The partially open position of the method may correspond to an EGR valve position where an EGR flow rate is higher than EGR flow rates in the more closed position and the fully closed position.

The method may further include holding the EGR valve at a set position by adjusting a power supplied to the valve actuator of the EGR valve. Adjusting the power supplied may include an increase in the power supplied to the valve actuator of the EGR valve, a decrease in the power supplied to the valve actuator of the EGR valve, or an adjustment to the power supplied to the valve actuator of the EGR valve so that the valve is held at the set position.

The power supplied to the EGR valve may be a duty cycle or a driving current.

Here, when valve actuator is referred to it is meant as all devices capable of actuating the valve. For example, a motor or solenoid could be used. It is also intended that the terms "driving current", "duty cycle", and "power" are read interchangeably since current and duty cycle are merely types of power than can be applied to the EGR valve actuator.

In some examples, movement of the EGR valve may be detected by determining when a movement of the EGR valve is above a predetermined threshold in a direction of movement of the EGR valve. For example, it will be understood that when the EGR valve is a poppet valve comprising a valve stem, the EGR valve will move substantially along a direction parallel to the valve stem. Movement, may therefore be detected when it is determined that the EGR valve has moved greater than a predetermined threshold amount in the direction required to open the EGR valve. It will therefore be understood that movement may not be detected if the EGR valve has surpassed the predetermined threshold but in the opposite direction (e.g. the direction used to close the EGR valve, if movement from a closed to an open position is to be detected). Additionally or alternatively, in some examples, movement of the EGR valve in either a more closed direction or a more open direction may be detected. The more closed direction may correspond to a movement of the EGR valve from a more open position to a more closed position. As such, the more open direction may correspond to a movement of the EGR valve from a more closed position to a more open position. The predetermined threshold amount may be a distance or a speed.

The degree to which the valve is opened may be selected so that a force of the return spring will not dominate the dynamics. The force of the return spring may increase as the EGR valve is moved further toward the fully open position due to the return spring elongating. As such, the predetermined open position may be selected based on a position where a power used to open the EGR valve is relatively low and where the return spring may force the valve closed in response to an absence of power supplied to a valve actuator. Accordingly, the predetermined open position of the valve may be a partially open position substantially equal to 30% of the fully open position. That is to say, the predetermined open position may more closely resemble the fully closed position compared to the fully open position. As such, the partially open position of 30% or greater of the fully open position may mitigate an impact of the return spring on the breakaway power, but also provide sufficient travel time of the valve during closing to permit measurements.

In one example, additionally or alternatively, the fully closed position may correspond to a position of the EGR valve when zero power is supplied to the valve actuator of the EGR valve. This may allow the EGR valve to return to its fully closed position. The EGR valve may be timed as it moves from the predetermined partially open position to the fully closed position. As described above, the time elapsed for the EGR valve to move from the predetermined partially open position to the fully closed position or to a more closed position between the predetermined partially open position and the fully closed position is described as a hang time. The greater the hang time, then the greater force a static friction acts against the EGR valve, which may be due to a degraded return spring and/or fouling of the EGR valve. For example, particulates accumulated at the EGR valve may apply a counter force to a force of the return spring, therein delaying movement of the EGR valve to a more closed position.

The diagnostic method may be performed at the end of a drive cycle, for example. Additionally or alternatively, the diagnostic method may be performed after a valve cleaning cycle.

In some examples, entry conditions which may signal for the diagnostic method to be executed may include one or more of a position sensor of the EGR valve is not degraded, a battery voltage and/or a battery state of charge is above a lower threshold SOC so that the diagnostic method may be executed along with other vehicle functions during a subsequent engine start, the previous engine drive cycle prior to the engine deactivation elapsed for more than a predetermined period of time, an end-stop learning cycle for the EGR valve has been completed, the engine coolant temperature is above a threshold temperature. The position sensor may be degraded if an EGR flow rate does not match a position provided by the position sensor when the engine is activated. By monitoring if the previous engine drive cycle is greater than the predetermined period of time, an increased number of diagnostic tests due to short drive cycles may be avoided. In one example, the predetermined period of time may be time or distance based. The end-stop learning cycle may correspond to learning positions of the EGR valve. Lastly, by initiating the diagnostic when the engine coolant temperature is above the threshold temperature, friction due to cool temperatures less than the threshold temperature may be avoided so that continuity between diagnostic tests may be maintained. As such, diagnostic tests may be comparable to one another. If one or more of the above conditions is not met, then the diagnostic method may not be executed.

Additionally, a diagnostic method already underway may be aborted if, for example, a valve position sensor has failed, the battery SOC is less than the threshold SOC, the end positions of the valve are not known, and the coolant temperature is less than the threshold temperature.

In some examples, the diagnostic method may be repeated consecutively during a single engine off event to provide a plurality of EGR valve results, wherein an average for each of the corresponding results may be calculated. For example, two or more values may be gathered for the EGR valve hang time, wherein an average hang time for the EGR valve may be determined.

The method may further comprise calculating at least one of an average value of the power used to cause the EGR valve to open (e.g., the average breakaway power). An average value of the power used to hold the EGR valve at the predetermined open position (e.g., the average holding power). An average value of the times between setting the power supplied to the EGR valve actuator to zero and the start of the EGR valve movement towards the closed position (e.g., an average hang time). An average value of the time for the EGR valve to travel to within a set distance from the closed position of the EGR valve (e.g., an average travel time). An average speed of the EGR valve to travel from the predetermined open position to within a set distance from the closed position of the EGR valve (e.g., an average valve speed).

Herein, the average breakaway power may be referred to as function f1. The average holding power may be referred to as function f2. The average hang time may be referred to as function f3. The average travel time may be referred to as function f4. The average valve speed may be referred to as function f5.

At least one of the functions may be polynomial. For example, at least one of the functions may be linear. The diagnostic method may further comprise determining the maximum value of all of the functions f1, f2, f3, f4, and f5, max (f1, f2, f3, f4, f5), and outputting the valve max (f1, f2, f3, f4, f5). If this maximum value max (f1, f2, f3, f4, f5) is greater than a predetermined threshold, the method may further comprise outputting a determination that the EGR valve demands cleaning, and/or instigating a cleaning operation to clean the EGR valve.

It will be understood that any combination of the previously described averages, functions and maximums are within the scope of the present disclosure. For example, the steps of the diagnostic method may be performed and repeated four times but only the average value of the average speed may be of interest. In that case a single function of the average speed may be calculated and the maximum of that function may be the value outputted.

By way of a further illustrative example, the diagnostic method may be performed and repeated twice and the average holding power and the average valve speed only may be calculated across the three cycles. Then, two functions, one of the average holding power and one of the average valve speed, may be defined. The maximum value of these two functions may then be selected as the output.

The diagnostic method may further comprise setting the power supplied to the EGR valve actuator so as to cause the EGR valve to open to a partially open position, setting the power supplied to the EGR valve actuator to zero so as to cause the EGR valve to fall back to a resting position, and when the EGR valve has fallen back to its resting position, recording the resting positon of the EGR valve.

For some valve shapes, the mechanical rest position of the valve (e.g. when no driving current is applied to the valve motor/actuator/solenoid etc.) may not be equal to the fully closed position. Instead, for some valve shapes and/or configurations the valve may rest slightly open (e.g. by 10% of the travel distance between the fully open and fully closed positions). As such, the resting position may not be equal to the fully closed position in some configurations of the EGR valve.

Furthermore, if a valve has been held in the fully closed position, then removing the power (e.g. driving current) may not necessarily return the valve to its partially open mechanical rest position. This may be due to the spring force on the valve being relatively low at this point of its movement range in combination with friction on the valve stem and/or the valve seat increasing due to contamination and/or fouling. It is therefore desirable to run the above described diagnostic method where the EGR valve is returned not to its fully closed position (or not to a position very near its fully closed position) but to a natural resting position of the valve when power provided to the valve actuator is substantially equal to zero. This has the effect of mitigating errors caused if the fully closed position (or a position near it) of the valve is used when it is not appropriate to do so, thereby giving erroneous results.

As such, the purpose of a method to determine the mechanical resting position of the valve prior to the diagnostic method may be desired.

It may be determined that the EGR valve has reached its resting position when valve movement has ceased. The resting position may be determined when the speed of the EGR valve is equal to a predetermined speed. It may be determined that the EGR valve has reached its resting positon when a fixed time has elapsed following setting the power supplied to the EGR valve actuator to zero. The fixed time may be, for example, 2 seconds. The predetermined speed may be zero.

The EGR valve resting position may be determined prior to the EGR valve diagnostic occurring. In some examples, this may occur during a single engine off event or over multiple engine off events. The set distance may be such that the EGR valve travels to the resting positon and is saved in memory of a controller. As described above, this allows the resting position of the valve to be used in the diagnostic method.

The diagnostic method may be performed if it is determined that the EGR valve resting position is between 5% and 15% of the maximum travel distance of the valve. The diagnostic method may be aborted if it is determined that the EGR valve resting position lies outside of the range of between 5% and 15% of the maximum travel distance of the valve. The range 5% to 15% may be an expected range of positions of the valve in use (e.g. it may be expected that the resting position of the valve will lie within this range). Additionally or alternatively, the resting position may correspond to the fully closed position. Herein, the resting position may correspond to a 0% position of the maximum travel distance of the EGR valve and a fully open position may correspond to a 100% position of the maximum travel distance of the EGR valve.

Thus, determining the resting position may be referred to herein as a preconditioning phase. The additional valve movement comprises opening the valve to a partially open position, reducing the power so that the valve falls back to its resting position, which may be distinct from the valve closed position. Once the valve movement has ceased, this valve position is recorded as its resting position. The resting position is used in the diagnostic method to represent the end of valve travel. In some examples, the diagnostic method may not be executed if the resting position corresponds to the fully closed position. If the resting position is equal to the fully closed position, then accumulation of particulates and other EGR compounds may be too low to affect EGR valve operation. In this way, the resting position being equal to the fully closed position may be indicative of the EGR valve operating as desired.

FIG. 1 depicts an engine system 100 for a vehicle. The vehicle may be an on-road vehicle having drive wheels which contact a road surface. Engine system 100 includes engine 10 which comprises a plurality of cylinders. FIG. 1 describes one such cylinder or combustion chamber in detail. The various components of engine 10 may be controlled by electronic engine controller 12.

Engine 10 includes a cylinder block 14 including at least one cylinder bore, and a cylinder head 16 including intake valves 152 and exhaust valves 154. In other examples, the cylinder head 16 may include one or more intake ports and/or exhaust ports in examples where the engine 10 is configured as a two-stroke engine. The cylinder block 14 includes cylinder walls 32 with piston 36 positioned therein and connected to crankshaft 40. Thus, when coupled together, the cylinder head 16 and cylinder block 14 may form one or more combustion chambers. As such, the combustion chamber 30 volume is adjusted based on an oscillation of the piston 36. Combustion chamber 30 may also be referred to herein as cylinder 30. The combustion chamber 30 is shown communicating with intake manifold 144 and exhaust manifold 148 via respective intake valves 152 and exhaust valves 154. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57. Thus, when the valves 152 and 154 are closed, the combustion chamber 30 and cylinder bore may be fluidly sealed, such that gases may not enter or leave the combustion chamber 30.

Combustion chamber 30 may be formed by the cylinder walls 32 of cylinder block 14, piston 36, and cylinder head 16. Cylinder block 14 may include the cylinder walls 32, piston 36, crankshaft 40, etc. Cylinder head 16 may include one or more fuel injectors such as fuel injector 66, one or more intake valves 152, and one or more exhaust valves such as exhaust valves 154. The cylinder head 16 may be coupled to the cylinder block 14 via fasteners, such as bolts and/or screws. In particular, when coupled, the cylinder block 14 and cylinder head 16 may be in sealing contact with one another via a gasket, and as such the cylinder block 14 and cylinder head 16 may seal the combustion chamber 30, such that gases may only flow into and/or out of the combustion chamber 30 via intake manifold 144 when intake valves 152 are opened, and/or via exhaust manifold 148 when exhaust valves 154 are opened. In some examples, only one intake valve and one exhaust valve may be included for each combustion chamber 30. However, in other examples, more than one intake valve and/or more than one exhaust valve may be included in each combustion chamber 30 of engine 10.

In some examples, each cylinder of engine 10 may include a spark plug 192 for initiating combustion. Ignition system 190 can provide an ignition spark to cylinder 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

Fuel injector 66 may be positioned to inject fuel directly into combustion chamber 30, which is known to those skilled in the art as direct injection. Fuel injector 66 delivers liquid fuel in proportion to the pulse width of signal FPW from controller 12. Fuel is delivered to fuel injector 66 by a fuel system (not shown) including a fuel tank, fuel pump, and fuel rail. Fuel injector 66 is supplied operating current from driver 68 which responds to controller 12. In some examples, the engine 10 may be a gasoline engine, and the fuel tank may include gasoline, which may be injected by injector 66 into the combustion chamber 30. However, in other examples, the engine 10 may be a diesel engine, and the fuel tank may include diesel fuel, which may be injected by injector 66 into the combustion chamber. Further, in such examples where the engine 10 is configured as a diesel engine, the engine 10 may include a glow plug to initiate combustion in the combustion chamber 30.

Intake manifold 144 is shown communicating with throttle 62 which adjusts a position of throttle plate 64 to control airflow to engine cylinder 30. This may include controlling airflow of boosted air from intake boost chamber 146. In some embodiments, throttle 62 may be omitted and airflow to the engine may be controlled via a single air intake system throttle (AIS throttle) 82 coupled to air intake passage 42 and located upstream of the intake boost chamber 146. In yet further examples, AIS throttle 82 may be omitted and airflow to the engine may be controlled with the throttle 62.

In some embodiments, engine 10 is configured to provide exhaust gas recirculation, or EGR. When included, EGR may be provided as high-pressure EGR and/or low-pressure EGR. In examples where the engine 10 includes low-pressure EGR, the low-pressure EGR may be provided via EGR passage 135 and EGR valve 138 to the engine air intake system at a position downstream of air intake system (AIS) throttle 82 and upstream of compressor 162 from a location in the exhaust system downstream of turbine 164. EGR may be drawn from the exhaust system to the intake air system when there is a pressure differential to drive the flow. A pressure differential can be created by partially closing AIS throttle 82. Throttle plate 84 controls pressure at the inlet to compressor 162. The AIS may be electrically controlled and its position may be adjusted based on optional position sensor 88.

Ambient air is drawn into combustion chamber 30 via intake passage 42, which includes air filter 156. Thus, air first enters the intake passage 42 through air filter 156. Compressor 162 then draws air from air intake passage 42 to supply boost chamber 146 with compressed air via a compressor outlet tube (not shown in FIG. 1). In some examples, air intake passage 42 may include an air box (not shown) with a filter. In one example, compressor 162 may be a turbocharger, where power to the compressor 162 is drawn from the flow of exhaust gases through turbine 164. Specifically, exhaust gases may spin turbine 164 which is coupled to compressor 162 via shaft 161. A wastegate 72 allows exhaust gases to bypass turbine 164 so that boost pressure can be controlled under varying operating conditions. Wastegate 72 may be closed (or an opening of the wastegate may be decreased) in response to increased boost demand, such as during an operator pedal tip-in. By closing the wastegate, exhaust pressures upstream of the turbine can be increased, raising turbine speed and peak power output. This allows boost pressure to be raised. Additionally, the wastegate can be moved toward the closed position to maintain desired boost pressure when the compressor recirculation valve is partially open. In another example, wastegate 72 may be opened (or an opening of the wastegate may be increased) in response to decreased boost demand, such as during an operator pedal tip-out. By opening the wastegate, exhaust pressures can be reduced, reducing turbine speed and turbine power. This allows boost pressure to be lowered.

However, in alternate embodiments, the compressor 162 may be a supercharger, where power to the compressor 162 is drawn from the crankshaft 40. Thus, the compressor 162 may be coupled to the crankshaft 40 via a mechanical linkage such as a belt. As such, a portion of the rotational energy output by the crankshaft 40, may be transferred to the compressor 162 for powering the compressor 162.

Compressor recirculation valve 158 (CRV) may be provided in a compressor recirculation path 159 around compressor 162 so that air may move from the compressor outlet to the compressor inlet so as to reduce a pressure that may develop across compressor 162. A charge air cooler 157 may be positioned in boost chamber 146, downstream of compressor 162, for cooling the boosted aircharge delivered to the engine intake. However, in other examples as shown in FIG. 1, the charge air cooler 157 may be positioned downstream of the electronic throttle 62 in an intake manifold 144. In some examples, the charge air cooler 157 may be an air to air charge air cooler. However, in other examples, the charge air cooler 157 may be a liquid to air cooler.

In the depicted example, compressor recirculation path 159 is configured to recirculate cooled compressed air from upstream of charge air cooler 157 to the compressor inlet. In alternate examples, compressor recirculation path 159 may be configured to recirculate compressed air from downstream of the compressor and downstream of charge air cooler 157 to the compressor inlet. CRV 158 may be opened and closed via an electric signal from controller 12. CRV 158 may be configured as a three-state valve having a default semi-open position from which it can be moved to a fully-open position or a fully-closed position.

Universal Exhaust Gas Oxygen (UEGO) sensor 126 is shown coupled to exhaust manifold 148 upstream of emission control device 70. Alternatively, a two-state exhaust gas oxygen sensor may be substituted for UEGO sensor 126. Emission control device 70 may include multiple catalyst bricks, in one example. In another example, multiple emission control devices, each with multiple bricks, can be used. While the depicted example shows UEGO sensor 126 upstream of turbine 164, it will be appreciated that in alternate embodiments, UEGO sensor may be positioned in the exhaust manifold downstream of turbine 164 and upstream of emission control device 70. Additionally or alternatively, the emission control device 70 may comprise a diesel oxidation catalyst (DOC) and/or a diesel cold-start catalyst, a particulate filter, a three-way catalyst, a $NO_x$ trap, selective catalytic reduction device, and combinations thereof. In some examples, a sensor may be arranged upstream or downstream of the emission control device 70, wherein the sensor may be configured to diagnose a condition of the emission control device 70.

Controller 12 is shown in FIG. 1 as a microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an input device 130 for sensing input device pedal position (PP) adjusted by a vehicle operator 132; a knock sensor for determining ignition of end gases (not shown); a measurement of engine manifold pressure (MAP) from pressure sensor 121 coupled to intake manifold 144; a measurement of boost pressure from pressure sensor 122 coupled to boost chamber 146; an engine position sensor from a Hall effect sensor 118 sensing crankshaft 40 position; a measurement of air mass entering the engine from sensor 120 (e.g., a hot wire air flow meter); and a measurement of throttle position from sensor 58. Barometric pressure may also be sensed (sensor not shown) for processing by controller 12. In a preferred aspect of the present description, Hall effect sensor 118 produces a predetermined number of equally spaced pulses every revolution of the crankshaft from which engine speed (RPM) can be determined. The input device 130 may comprise an accelerator pedal and/or a brake pedal. As such, output from the position sensor 134 may be used to determine the position of the accelerator pedal and/or brake pedal of the input device 130, and therefore determine a desired engine torque. Thus, a desired engine torque as requested by the vehicle operator 132 may be estimated based on the pedal position of the input device 130.

In some examples, vehicle 5 may be a hybrid vehicle with multiple sources of torque available to one or more vehicle wheels 59. In other examples, vehicle 5 is a conventional vehicle with only an engine, or an electric vehicle with only electric machine(s). In the example shown, vehicle 5 includes engine 10 and an electric machine 52. Electric machine 52 may be a motor or a motor/generator. Crankshaft 40 of engine 10 and electric machine 52 are connected via a transmission 54 to vehicle wheels 59 when one or more clutches 56 are engaged. In the depicted example, a first clutch 56 is provided between crankshaft 40 and electric machine 52, and a second clutch 56 is provided between electric machine 52 and transmission 54. Controller 12 may send a signal to an actuator of each clutch 56 to engage or disengage the clutch, so as to connect or disconnect crankshaft 40 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 61 to provide torque to vehicle wheels 59. Electric machine 52 may also be operated as a generator to provide electrical power to charge battery 61, for example during a braking operation.

The controller 12 receives signals from the various sensors of FIG. 1 and employs the various actuators of FIG. 1 to adjust engine operation based on the received signals and instructions stored on a memory of the controller. For example, adjusting operation of the electric machine 52 may occur based on feedback from ECT sensor 112. As will be described in greater detail below, the engine 10 and electric machine 52 may be adjusted such that their operations may be delayed based on one or more of a powertrain temperature, which may be estimated based on feedback from ECT sensor 112, and a distance between an intended destination and an electric-only operation range.

Turning now to FIG. 2, it shows a system 200 of controlling the position of an EGR valve, such as EGR valve 138 of FIG. 1. A PID controller 210, which may be used similarly or as part of controller 10 of FIG. 1, receives at 211 a desired value of the position of the EGR valve and at 212 calculates a difference and/or an error between the desired value and a current, measured position of the EGR valve (which could, for example, be feedback from the output of the PID controller thus iteratively calculating the position of the valve). At 215, 216 and 217, respectively the proportional, integral, and derivate terms, P, I, and D, are calculated and are combined at 219 as a control variable, or control function, being the output of the PID controller. The control function may be used to apply a correction to the EGR valve position, the correction corresponding to the difference determined at 212.

A feedback loop 220 may relay the control function output as an input variable to the system so that the PID controller 210 may responsively adjust the controller operation so that the current measured position is substantially equal to the desired position.

The system 200 may also comprise a feed-forward term, calculated at 224, which is added to the output of the PID controller at 222 to form a combined output which is used to adjust the position of the EGR valve.

Turning now to FIG. 3, it shows the system 200 of FIG. 2 in greater detail. A first diagnostic valve factor DF1 may be calculated at 213 and is used to adjust the P, I, and D terms of the PID controller so that its output is influenced by the diagnostic factor. Accordingly, the P, I and D are adjusted, or corrected, by the diagnostic factor. These terms are represented by 215*a*, 216*a*, and 217*a* as the adjusted P, adjusted I and adjusted D, gains, respectively. Thus, the adjusted P, adjusted I, and adjusted D gains may be based on the difference and/or the error calculated for the current EGR valve position and the desired EGR valve position Similarly, a second diagnostic factor DF2 is calculated at 223 and is used to adjust the feed-forward term (calculated at 224), at 221, whose output at 222 is combined with the PID. In this way the feed-forward term is influenced by the second diagnostic factor DF2, and the combined output is influenced by both the first and second diagnostic factors, DF1 and DF2.

It will be understood that the notation "DF1" to refer to a "first" diagnostic factor being multiplied to each P, I and D term is chosen here for simplicity only. As will be described below, each of the P, I and D terms are not adjusted by the same diagnostic factor, although they could be the same in one possible arrangement.

Although separate notation has been used for the first and second diagnostic factors it will be understood that they may be the same. Even if the first and second diagnostic factors were the same the PID output and feed-forward signal may be adjusted in the same, or in a different way. For example, the PID output may be multiplied by a diagnostic factor and the feed-forward term may be added to the same diagnostic factor.

Figure 4:
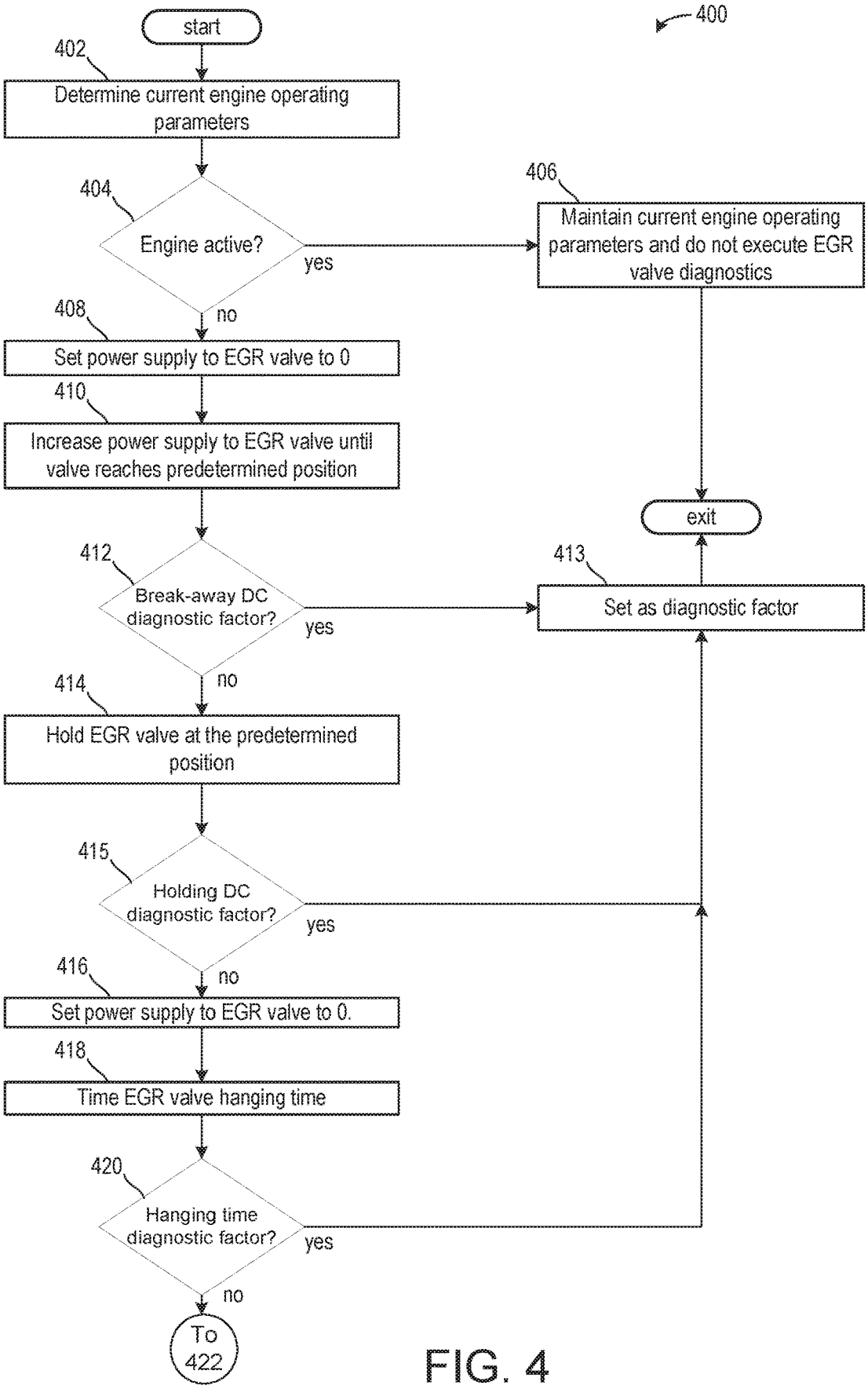
FIG. 4 illustrates an EGR valve diagnostic method.
Figure 4:
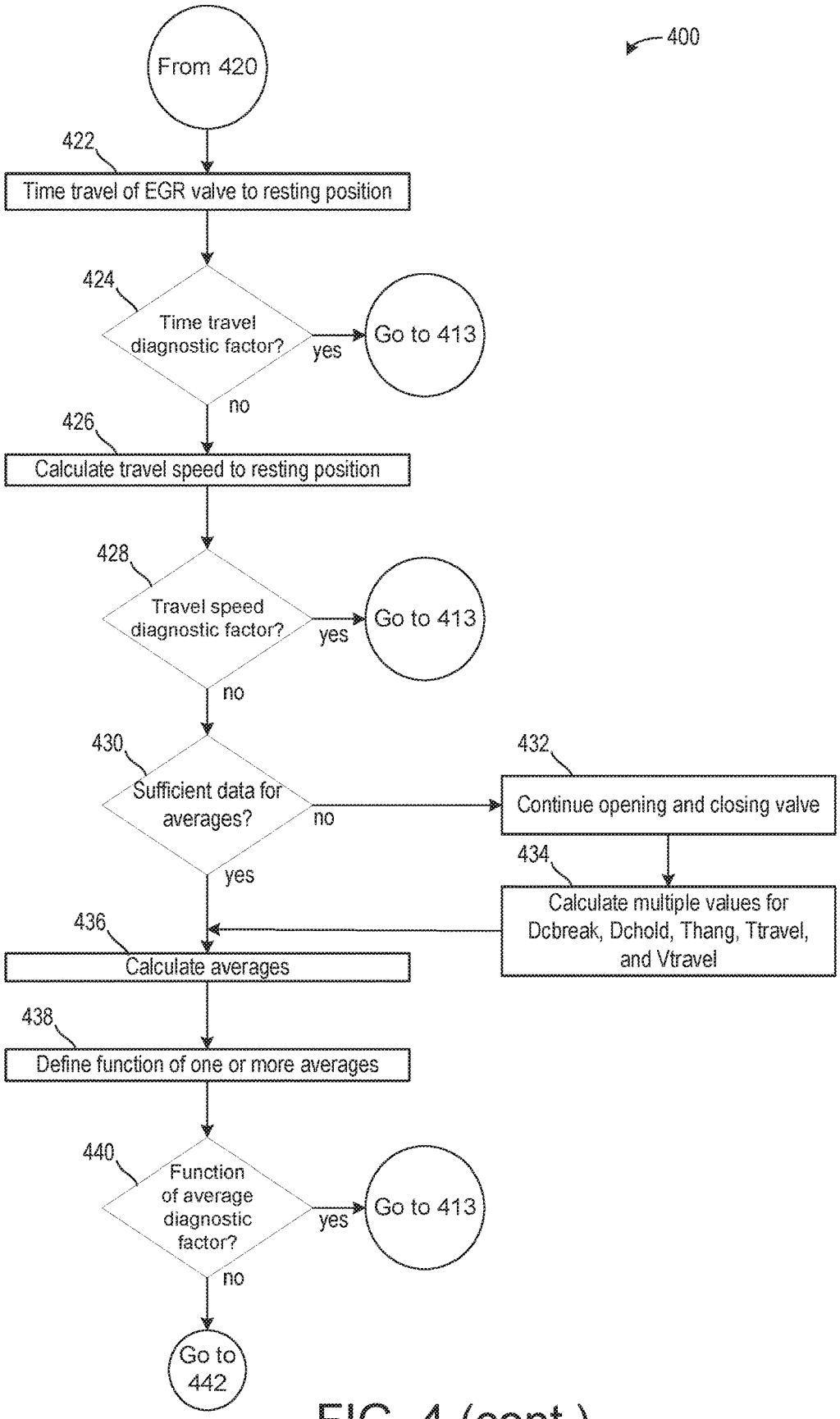
Figure 4:
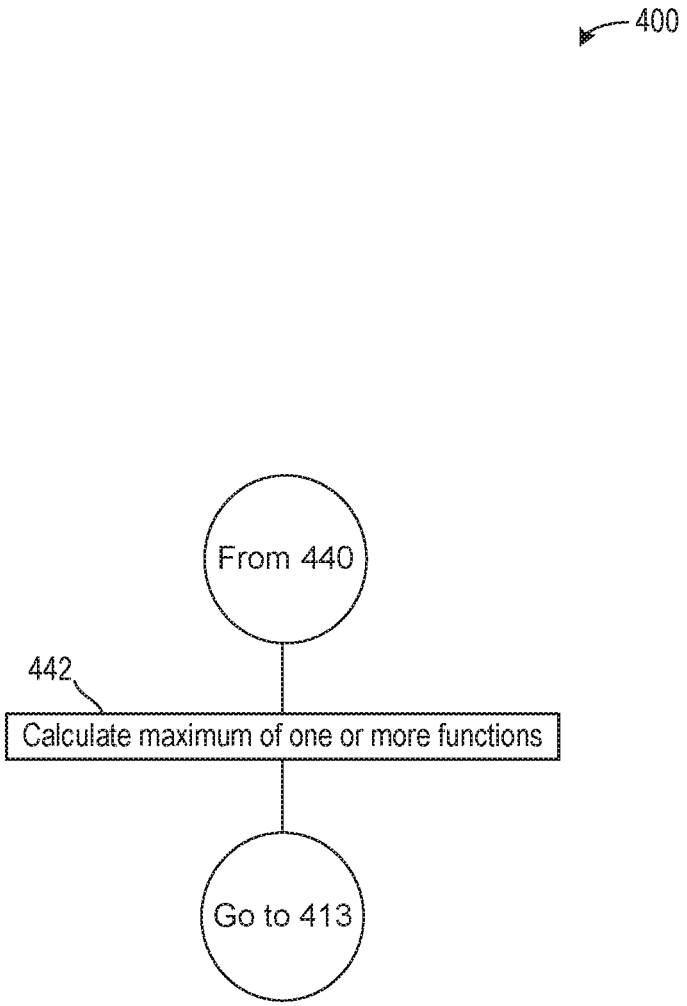

Turning now to FIG. 4, it shows an EGR valve diagnostic method 400. The diagnostic method may estimate a contamination of an EGR valve, such as EGR valve 138 of FIG. 1. Instructions for carrying out method 400 and the rest of the methods included herein may be executed by a controller based on instructions stored on a memory of the controller and in conjunction with signals received from sensors of the engine system, such as the sensors described above with reference to FIG. 1. The controller may employ engine actuators of the engine system to adjust engine operation, according to the methods described below.

The method 400 begins at 402, which includes determining one or more current engine operating parameters. Current engine operating parameters may include but are not limited to engine speed, throttle position, vehicle speed, and air/fuel ratio.

The method 400 proceeds to 404, which may include determining if the engine is deactivated. In some examples, this may include further determining if the vehicle is stationary. If the engine is not deactivated, then the engine may be active and combusting and the method 400 proceeds to 406, which may include maintaining current engine operating parameters and the EGR valve diagnostic routine is not executed.

If the engine is deactivated, then the method 400 proceeds to 408, which may include setting the power supplied to an EGR valve actuator is set to zero. If the engine is deactivated, this may already occur. However, by allowing the engine to be deactivated before initiating the EGR valve diagnostic routine, exhaust gas may not travel through the EGR valve, which may affect results, and coolant may still be warm, as will be described below. When the EGR valve actuator power supplied is set to zero, the EGR valve may move to a resting position.

The method 400 proceeds to 410, which may include increasing the power supplied to the EGR valve actuator to a value greater than zero until EGR valve reaches the predetermined position. In one example, the power supplied may be at a set rate of increase. Additionally, movement of the EGR valve may be monitored. This is referred to as the break-away duty cycle $DC_{break}$. $DC_{break}$ is therefore the duty cycle (the power) used to cause the EGR valve to open and/or to move out of the resting position, which corresponds to a position of the EGR valve when the power supply was set to zero at 408.

The method 400 proceeds to 413, which includes determining if the break-away DC is the diagnostic factor. In one example, the diagnostic factor may be selected based on previously selected diagnostic factors. For example, if during a previous execution of the method 400 included selecting the break-away DC as the diagnostic factor, then a subsequent execution of the method 400 may include not selecting the break-away DC as the diagnostic factor. In some examples, additionally or alternatively, multiple factors may be selected to produce multiple diagnostic factors. In this way, the break-away DC may be selected to be a diagnostic factor for consecutive executions of the method 400. If the break-away DC is the diagnostic factor, then the method 400 proceeds to 413, which includes setting $DC_{break}$ as the diagnostic factor. As described above and as will be described in greater detail below with respect to FIGS. 8 and 9, the diagnostic factor may be used to adjust one or more of the PID output and/or feed-forward output.

If the $DC_{break}$ is not one of the diagnostic factors, then the method 400 proceeds to 414, which may include holding the EGR valve at the predetermined position. In some examples, additionally or alternatively, the method 400 may proceed to 414 if the $DC_{break}$ is a diagnostic factor. In this way, multiple diagnostic factors may be selected. The predetermined position may correspond to a position outside of the resting position. The valve duty cycle is adjusted or set to hold the EGR valve steady at a set position, $POS_{hold}$ for a set period of time. This may involve a further increase of the duty cycle to hold the valve steady at $POS_{hold}$, or a decrease of the duty cycle, or merely an adjustment of the duty cycle based on the power supplied at 410. $POS_{hold}$ may be selected such that the force of the return spring of the valve will not dominate the dynamics but should also provide sufficient valve travel time during closing to permit measurements. For example $POS_{hold}$ can be selected to be 30% of the valve opening, meaning 30% of the travel distance between the fully open and closed positions. Said another way, the EGR valve may be moved to a position 30% between the fully closed and fully open positions, wherein the position is nearer to the fully closed position than to the fully open position. The duty cycle used to hold the EGR valve steady at $POS_{hold}$ is referred to as the holding duty cycle $DC_{hold}$. It will be appreciated that the force of the return spring may increase as the EGR valve is moved closer to its fully open position, resulting in a greater impact of the return spring on the dynamics and/or movement of the EGR valve. As such, the predetermined position may be selected based on a position where the return spring may apply less force, wherein the force applied is sufficient for measuring a movement of the EGR valve to the resting position.

In some examples, the EGR valve is maintained at the predetermined position for a threshold amount of time. The threshold amount of time may be less than five seconds. In some examples, the threshold amount of time is two seconds or less.

The method 400 proceeds to 415, which includes determining if the $DC_{hold}$ is the diagnostic factor. In one example, each of the $DC_{hold}$ and $DC_{break}$ may be selected as diagnostic factors. As another example, only one may be selected to be a diagnostic factor. If $DC_{hold}$ is the only diagnostic factor or if it is one of the diagnostic factors, then the method 400 proceeds to 413 as described above where $DC_{hold}$ is set as a diagnostic factor.

If the $DC_{hold}$ is not a diagnostic factor, or if multiple diagnostic factors are desired, then the method 400 proceeds to 416, which may include setting the power supply to the EGR valve to zero. As such, the EGR valve may begin to move to a resting position, away from the predetermined position.

The method 400 proceeds to 418, which may include timing an EGR valve hanging time. Said another way, 418 may include timing a delay of the EGR valve moving from the predetermined position to the resting position once the power supply is set to zero. This is referred to as the hang time $t_{hang}$. $t_{hang}$ is therefore the amount of time that the EGR valve "hangs" or "sticks" in the predetermined position in which it was held at 414 ($POS_{hold}$) before falling back to its closed position. $t_{hang}$ may increase as contamination of the EGR valve increases, as will be described below.

The method 400 proceeds to 420, which includes determining if the hanging time ($t_{hang}$) is a diagnostic factor. If $t_{hang}$ is a diagnostic factor, then the method 400 proceeds to 413 to set $t_{hang}$ as a diagnostic factor.

If $t_{hang}$ is not a diagnostic factor or if $t_{hang}$ is one of a plurality of diagnostic factors, then the method 400 proceeds to 422, which may include timing a travel of the EGR valve to the resting position from the predetermined position. Said another way, the time taken for the valve to travel to within a set distance of the closed position, $POS_{closed}$, is measured. This is the travel time $t_{travel}$. Thus, $t_{travel}$ is the time taken for the EGR valve to travel from $POS_{hold}$ to $POS_{closed}+x$, where x is a set distance. In one possible arrangement, the set distance may be zero.

The method 400 proceeds to 424, which includes determining if the travel time ($t_{travel}$) is a diagnostic factor. If $t_{travel}$ is a diagnostic factor, then the method 400 proceeds to 413 to set $t_{travel}$ as a diagnostic factor.

If $t_{travel}$ is not a diagnostic factor or if $t_{travel}$ is one of a plurality of diagnostic factors, then the method 400 proceeds to 426, which may include calculating a valve travel speed as it moves from the predetermined position at which it was held to the resting position. Said another way, the valve's speed of travel when falling from $POS_{hold}$ to within the set distance from its closed position is calculated, $v_{travel}$. This may be calculated as follows. The distance travelled by the EGR valve, when falling from $POS_{hold}$ to within the set distance of the closed positon, is calculated. That distance, $L_{travel}$, is calculated by formula 1 below:

$$L_{travel}=POS_{hold}-POS_{closed}.$$

In other words, the distance travelled by the valve is the distance from its held set position to its closed position. In the formula 1, $POS_{closed}$ is intended not only to refer to the fully closed position of the valve but also to a resting position which may a set distance from the closed position. If the set distance is zero, then the two values are the same. Accordingly, in the formula 1 $POS_{closed}$ may be, or may be replaced with, $POS_{closed}+x$. The valve's speed of travel when falling from $POS_{hold}$ to within the set distance from its closed position, $v_{travel}$, is therefore calculated by formula 2 below:

$$v_{travel}=\frac{L_{travel}}{t_{travel}}.$$

The method 400 proceeds to 428 to determine if travel speed ($v_{travel}$) is a diagnostic factor. Thus, if $v_{travel}$ is a diagnostic factor, then the method 400 proceeds to 413 at which $v_{travel}$ is outputted as the diagnostic factor.

Additionally or alternatively, the diagnostic factor may be selected to be a function of at least one of $DC_{break}$, $DC_{hold}$, $t_{hang}$, $t_{travel}$, and $v_{travel}$. Thus, the diagnostic factor may comprise defining a function $f$, where $$f=f(DC_{break}, DC_{hold}, t_{hang}, t_{travel}, v_{travel}).$$

It will be understood that the dependence of the function $f$ on any one of its parameters may be zero or non-zero. Accordingly, $f$ may have non-zero dependence on $DC_{break}$, but a zero dependence on $DC_{hold}$, $t_{hang}$, $t_{travel}$, $v_{travel}$, meaning $f$ is a function of $DC_{break}$ only.

Alternatively, a function g may be defined which is a function of the direction of movement of the EGR valve, x, and at least one of $DC_{break}$, $DC_{hold}$, $t_{hang}$, $t_{travel}$, and $v_{travel}$:

$$g=g(x, DC_{break}, DC_{hold}, t_{hang}, t_{travel}, v_{travel}).$$

As above, the dependence on any of $DC_{break}$, $DC_{hold}$, $t_{hang}$, $t_{travel}$, $v_{travel}$ may be zero in which case g is a function of the direction of valve movement only. Thus, in one possible arrangement the diagnostic factor may be selected to be a function of the direction of valve movement only. In such an example, the function g may be the identity function, in which case the diagnostic factor may be selected to be the direction of valve movement. *If* $v_{travel}$ is not a diagnostic factor or if $v_{travel}$ is only one of a plurality of diagnostic factors, then the method 400 may proceed to 430 to determine if sufficient data has been gathered to determine averages. In one example, sufficient data may include comprising at least two or more values for each of the breakaway values, holding values, hang time values, travel time values, and travel speed values. If sufficient data is not gathered, then the method 400 may proceed to 432 to continue opening and closing the EGR valve. The method 400 proceeds to 434, to calculate multiple values for $DC_{break}$, $DC_{hold}$, $t_{hang}$, $t_{travel}$, and $v_{travel}$. This may include repeating 408 through 422 multiple times within a single engine off event or over multiple engine off events.

If sufficient data has been gathered at 430 or after sufficient data has been gathered following 434, then the method 400 proceeds to 436 to calculate averages for each of the $DC_{break}$, $DC_{hold}$, $t_{hang}$, $t_{travel}$, and $v_{travel}$.

The averages of the breakaway duty cycles, the averages of the holding duty cycles, the average value of the hang times, and the average value of the travel times, and valve speeds are calculated. These average values will be denoted as $\overline{DC}_{break}$, $\overline{DC}_{hold}$, $\bar{t}_{hang}$, $\bar{t}_{travel}$, and $\bar{v}_{travel}$, respectively. $\overline{DC}_{break}$, $\overline{DC}_{hold}$, $\bar{t}_{hang}$, $\bar{t}_{travel}$, and $\bar{t}_{travel}$ are therefore calculated over the number of repetitions of steps 408-426. For example, if steps 408-426 have been repeated three times, there will be four values of each of $DC_{break}$, $DC_{hold}$, $t_{hang}$, $t_{travel}$ and $v_{travel}$ and each of the four values for each quantity will be averaged. As there will be values of $POS_{hold}$, $POS_{closed}$, and $t_{travel}$ for each repetition of steps 408-426 there will also be multiple values of $L_{travel}$ and $t_{travel}$. At 436, these are therefore used to calculate the average value of the valve speeds.

The method 400 proceeds to 438, which may include defining a function of one or more of the $\overline{DC}_{break}$, $\overline{DC}_{hold}$, $\bar{t}_{hang}$, $\bar{t}_{travel}$, and $\bar{v}_{travel}$. Each function may be referred to as a valve stickiness factor. In one example, a function for each average is determined such that $f_1$, $f_2$, $f_3$, $f_4$, $f_5$, respectively correspond to $\overline{DC}_{break}$, $\overline{DC}_{hold}$, $\bar{t}_{hang}$, $\bar{t}_{travel}$, and $\bar{v}_{travel}$. Thus, $f_1$ is the breakaway duty cycle stickiness factor and is a function of the average breakaway duty cycle, $f_1=f_1(\overline{DC}_{break})$: $f_2$ is the holding duty cycle stickiness factor and is a function of the average holding duty cycle, i.e. $f_2=f_2(\overline{DC}_{hold})$. $f_3$ is the hang time stickiness factor and is a function of the average hang time, i.e. $f_3=f_3(\bar{t}_{hang})$. $f_4$ is the travel time stickiness factor and is a function of the average travel time, i.e. $f_4=f_4(\bar{t}_{travel})$. $f_5$ is the valve speed stickiness factor and is a function of the average valve speed, i.e. $f_5=f_5(\bar{v}_{travel})$.

The functions $f_1$, $f_2$, $f_3$, $f_4$, and $f_5$ may be polynomial functions (e.g. linear functions). Alternatively they may represent the output of an individual look-up table using their inputs (e.g. $\overline{DC}_{break}$) as the input to the look-up table, the output being the corresponding valve stickiness factor to the input. $f_4$ may, for example, be the output of a look-up table having $\bar{v}_{travel}$ as its input. The functions may also be calibrated or tuned to provide different weighting to each of the test results. The functions allow a relationship between the measured parameter (e.g. valve speed) and the stickiness factor output. This relationship may be linear.

The method 400 proceeds to 440 to determine if one of the functions of the averages, $f_1$, $f_2$, $f_3$, $f_4$, and $f_5$, is a diagnostic factor. If one of the functions of the averages, $f_1$, $f_2$, $f_3$, $f_4$, and $f_5$, is a diagnostic factor, then the method 400 proceeds to 413 to set one or more of the functions as a diagnostic factor.

If one or more of the functions is not a diagnostic factor or one or more of the functions are a set of diagnostic factors and more diagnostic factors are desired, then the method 400 may proceed to 442, which may include calculating a maximum for the at least one function. In one example, the method 400 may include determining a maximum for each of the functions $f_1$, $f_2$, $f_3$, $f_4$, and $f_5$. The maximum of these individual stickiness factors is selected as the output of the diagnostic method 400, (e.g., $\max(f_1, f_2, f_3, f_4, f_5)$). The maximum values may provide a qualitative indication of the contamination of the EGR valve. The method 400 may proceed to 413 to set at least one of the maxima as a diagnostic factor.

Thus, method 400 may calculate five quantities, these five quantities representative of the valve stickiness (i.e. how much the valve may be contaminated) are monitored and an estimation is formed of how contaminated the EGR valve may be even though it may still be fully operational. The valve stickiness may be used to adjust EGR valve operations during a subsequent engine start.

Although "driving duty cycle" has been exemplified in the steps of method 400 this is merely one example of providing power to the EGR valve/EGR valve actuator. All suitable power sources can be used instead, or in addition, to driving duty cycle. Accordingly, driving current may be used instead of the duty cycle and therefore terminology such as $\overline{DC}_{break}$, being the average breakaway duty cycle, would be $\bar{I}_{break}$, being the average breakaway current etc. Such changes will be apparent to the skilled person if current were used in the steps of method 400 instead of the duty cycle.

It will also be understood that the diagnostic factor DF could be selected to be a function of at least one of the valve stickiness factors, i.e. DF=h, where $$h=h(f_1, f_2, f_3, f_4, f_5)$$

As above, the dependence may be zero or non-zero and the function may be a look-up table, or a polynomial etc.

The method 400 of FIG. 4 thus illustrates a diagnostic method that may measure and characterize a plurality of factors affecting valve performance, thereby giving an indication of a level of valve contamination, caused by deposits, and ageing.

According to method 400, movement of the EGR valve may be detected to accurately determine a contamination of the EGR valve. Detection of the valve movement (e.g. from the closed or from the held position) may be achieved by detecting a movement of the valve of more than a set size in the appropriate direction.

In some examples, the diagnostic factor may further include a comparison of $\overline{DC}_{break}$, $\overline{DC}_{hold}$, $\bar{t}_{hang}$, $\bar{t}_{travel}$, $\bar{v}_{travel}$ to a threshold breakaway power, a threshold hold power, a threshold hanging time, a threshold travel distance, and a threshold travel speed. The comparison may determine a difference between the measured value and its corresponding threshold, wherein as the difference increases, the diagnostic factor may increase (and therefore a valve stickiness value), which may result in an increased gain for the EGR valve operation, which may adjust EGR valve operations during a subsequent engine activation.

For example, as the $DC_{break}$ increases further beyond the threshold breakaway power, the diagnostic factor may increase. Similarly, as the $DC_{hold}$ increases further beyond the threshold holding power, the diagnostic factor may increase. As the $t_{hang}$ increases further beyond the threshold hanging time, the diagnostic factor may increase. As the $t_{travel}$ increases further beyond the threshold travel time, the diagnostic factor may increase. As the $v_{travel}$ decreases further below the threshold travel speed, the diagnostic factor may increase.

In one example, if a weight of the $DC_{hold}$ (e.g., its impact on the stickiness value) is relatively high, then power supplied to an actuator of the EGR valve may increase during an opening of the EGR valve. As another example, if a weight of the $t_{hang}$ is relatively high, then a signal to decrease power to the EGR actuator may be advanced to compensate for the hanging time. In one example, the advance is equal to a duration of the hanging time.

Figure 5:
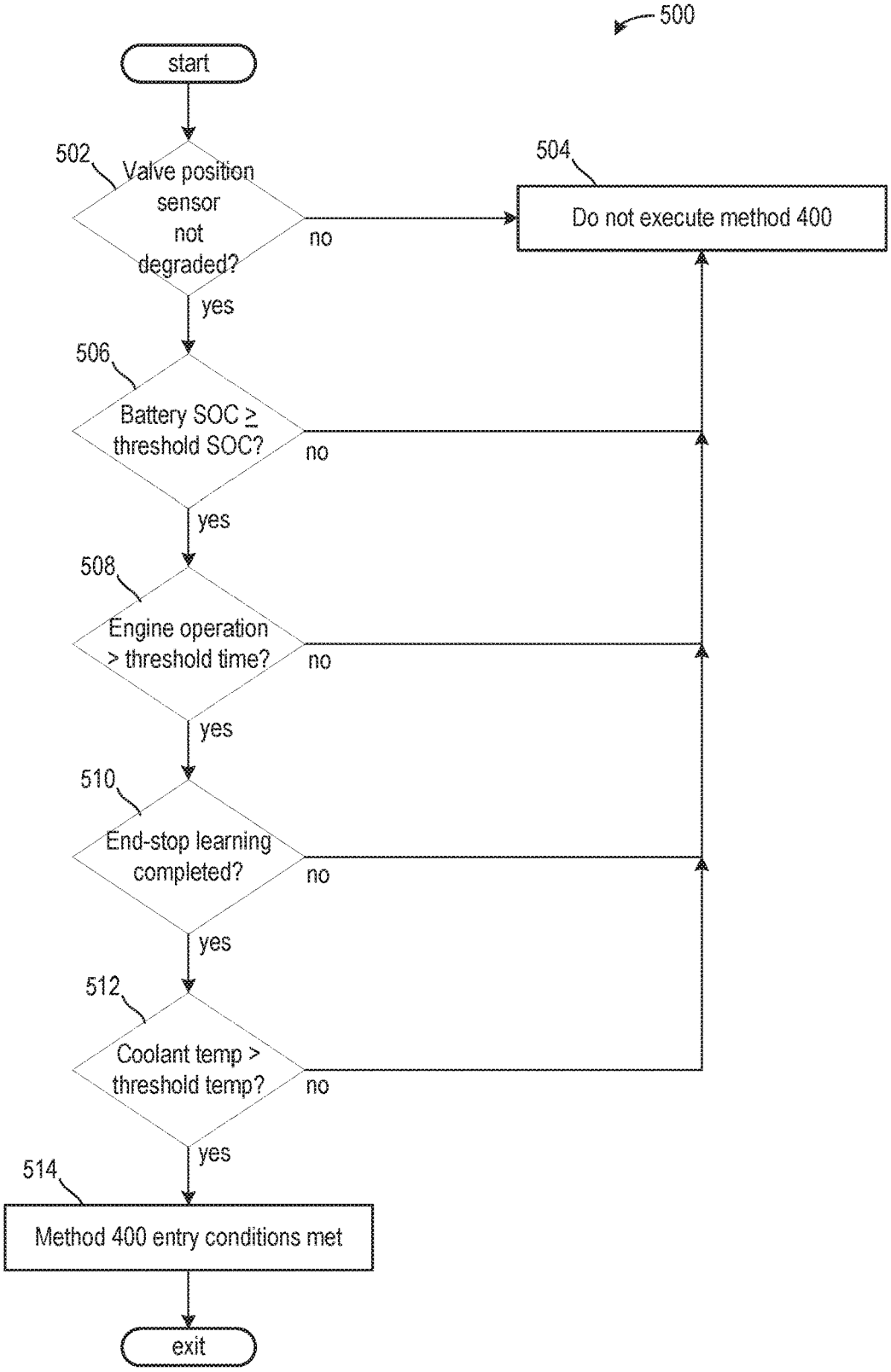
FIG. 5 illustrates a method for determining if one or more entry conditions for the EGR valve diagnostic method are met.
Figure 6:
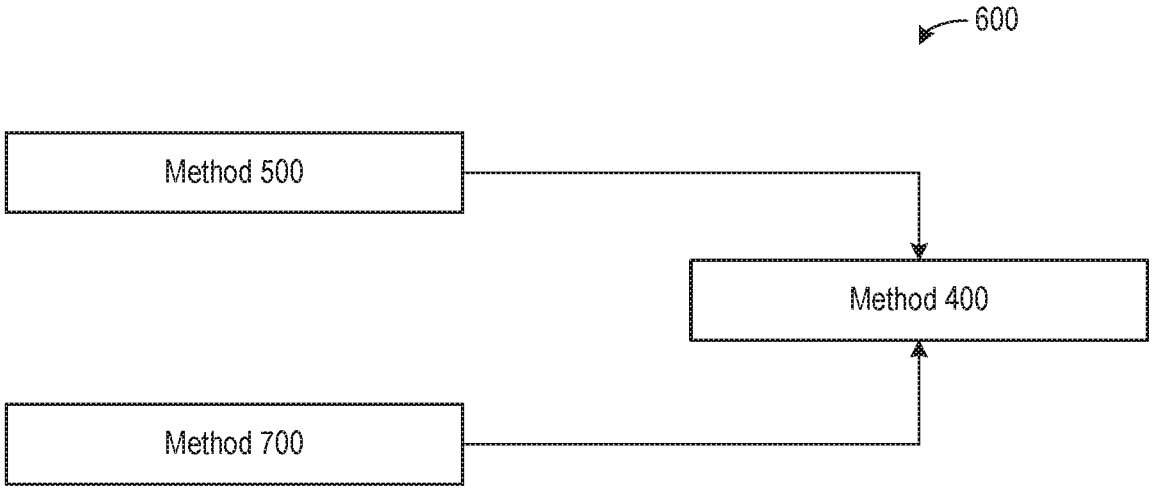
FIG. 6 illustrates a flow diagram illustrating methods executed prior to the EGR valve diagnostic method.

Turning now to FIG. 5, it shows a method 500 for determining if at least a subset of entry conditions for the method 400 of FIG. 4 are met. It will be appreciated that method 500 may be executed prior to execution of method 400 of FIG. 4. In some examples, method 500 may be executed while an engine is active. In some examples, method 500 may not be executed until a valve cleaning cycle has been performed.

The method 500 begins at 502, which includes determining if an EGR valve position sensor is not degraded. As described above, this may include determining if the EGR valve position sensor is providing feedback to a controller (e.g., controller 12 of FIG. 1). Additionally or alternatively, this may further include cross-checking current EGR flow rates with feedback from the EGR valve position sensor. If a degradation is present, then the method 500 proceeds to 504 which includes not executing the method 400.

If no degradations are present and the EGR valve position sensor is operating as desired, then the method 500 proceeds to 506, which includes determining if a battery SOC is greater than or equal to a threshold SOC. The threshold SOC may be based on a battery SOC sufficient to execute the method 200 along with engine start-up operations upon a subsequent engine start. If it is determined that the battery SOC is less than the threshold SOC, then the method 500 proceeds to 504 as described above.

If the battery voltage is greater than or equal to the threshold SOC, then the method 500 proceeds to 508 which includes determining if an engine operation prior to the EGR valve diagnostic method ran for more than a threshold duration of time. The threshold duration of time may be based on an amount of time so that repeated testing following brief engine cycles is avoided. The threshold duration of time may be a minute or less. If it is determined that the engine has not run for more than the threshold duration of time, then the method 500 proceeds to 504, as described above.

If the engine has run for more than the threshold duration of time, then the method 500 proceeds to 510 which includes determining if the end-stop learning cycle for the EGR valve has been previously completed. The end-stop learning cycle may comprise learning completed the end positions of the valve travel, which may at least comprise learning the resting position of the EGR valve. If the valve travel positions are not known, the method 500 proceeds to 504 as described above.

If the end-stop learning cycle has been completed, then the method 500 proceeds to 512 which includes determining if an engine coolant temperature is greater than a threshold temperature. The threshold temperature may be based on a coolant temperature to decrease test-to-test variability caused by increased friction of a cold valve mechanism and variation of the impedance of the valve solenoid with temperature. If it is determined that the engine coolant temperature is below the threshold temperature, then the method 500 proceeds to 504 as described above.

If the engine coolant temperature is above the threshold temperature, then the method 500 proceeds to 514 to indicate entry conditions for the method 400 are met.

Thus, method 500 checks one or more conditions to determine if conditions for the method 400 to be executed are met, the one or more conditions including a valve position sensor is not degraded, the battery SOC is greater than or equal to a threshold SOC, the previous engine cycle ran for greater than a threshold duration of time, an end-stop learning cycle for the EGR valve is completed, and that the engine coolant temperature is greater than a threshold temperature.

In some examples, the conditions monitored in method 500 may be continually monitored during the execution of method 400 of FIG. 4. If one of the conditions is not met, then the method 400 may be aborted. By doing this, a fidelity and comparability of results provided by the method 400 may be maintained so that EGR valve operation adjustments may provide more accurate EGR valve positioning.

Turning now to FIG. 6, it shows a chart 600 illustrating methods executed prior to method 400. That is to say, prior to the EGR valve diagnostic being executed, the method 500 of FIG. 5 may be executed and a method 700 of FIG. 7 may also be executed. The methods 500 and 700 may be executed simultaneously or in series without departing from the scope of the present disclosure.

Figure 7:
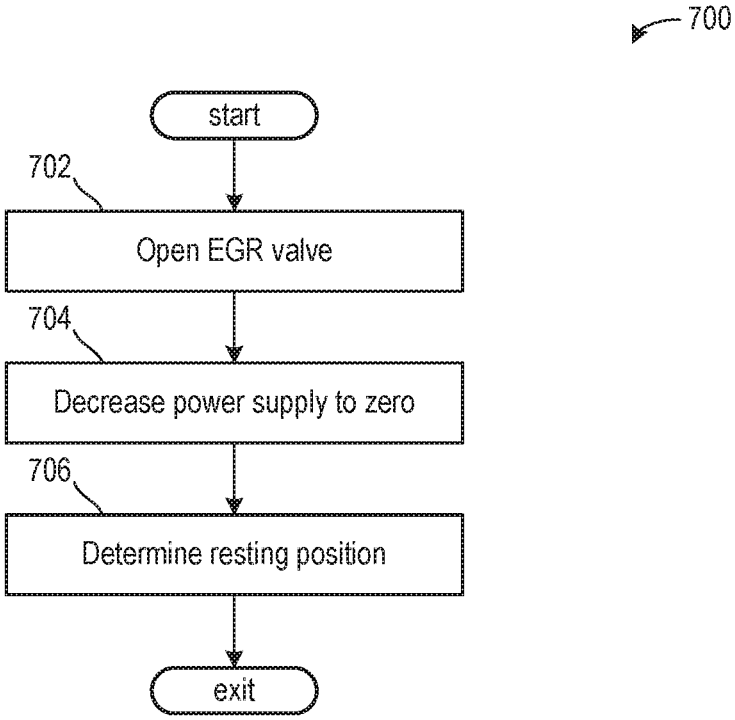
FIG. 7 illustrates a method for learning one or more positions of the EGR valve for executing the EGR valve diagnostic method.

Turning now to FIG. 7, it shows the method 700 for determining a resting position of the EGR valve. In one example, the method 700 may include the end-stop learning described above with respect to FIG. 5. In one example, method 700 is a pre-conditioning method and/or step prior to the method 400 of FIG. 4. The EGR valve may not (when power is reduced to zero) fall back to its fully closed position in some examples. It may, for example, fall back to a position that is open by 10% of the travel distance between the fully closed and fully open positions, described above as the resting position. Method 700 may determine the resting position of the EGR valve for use in the method 400 in place of the position $POS_{closed}$.

The method 700 begins at 702, which includes opening the EGR valve. This may include setting a power supply to the valve actuator to a power supply corresponding to a predetermined position.

The method 700 proceeds to 704, which includes decreasing the power supply to zero. This may cause the EGR valve to fall back to a resting position, or rest position, $POS_{rest}$. $POS_{rest}$ may be distinct from EGR valve fully closed position. The resting position may be stored in a look-up table, which may be used in methods 400 and 500. This resting position may be detected by recording the position of the EGR valve (and defining it as its resting position) once valve movement has ceased. In this way, the resting position of the EGR valve may change over time as a force of the return spring weakens or as particulates accumulate onto the EGR valve, thereby changing the resting position of the EGR valve. In one example, as particulate accumulation increases, the resting position may move further away from the fully closed position of the EGR valve.

When the method 700 is executed prior to method 400, the valve resting position $POS_{rest}$ may be used in the method 400 in place of the closed position $POS_{closed}$, to represent the end of valve travel during the test, (e.g., at 416 when the power supplied is set to zero the EGR valve will fall back to its rest position $POS_{rest}$). When method 700 is performed prior to method 400 the resting position may be used at 418 where $t_{travel}$ is the time taken for the EGR valve to travel from the set position $POS_{hold}$ to its rest position $POS_{rest}$ (as opposed to its closed position $POS_{closed}$).

This, in turn may modify the calculation of $v_{travel}$ which is dependent on $L_{travel}$ now defined above in terms of $POS_{rest}$. Thus, method 700, performed before method 400, may allow the resting position of the valve to be used, rather than the fully closed position to which the valve may not be able to return.

The method 700 proceeds to 706, which may include determining the EGR valve resting position. To determine the EGR valve's arrival at the resting position, the valve velocity may be calculated by dividing the change in valve position by the time taken to change position, or dividing the valve position by the time elapsed between repeated execution steps. Then, when the valve velocity in the closing direction falls below a preset threshold (a low threshold, such as zero) it may be determined that the valve has arrived at its resting position. Alternatively, it may be determined that the valve has arrived at its resting position when a fixed time has elapsed following removal of the power (e.g. following removal of a drive current or valve's duty cycle). This fixed time may be sufficiently large and empirically based on a time that the valve will have reached a stationary position, for example the fixed time may be 2 seconds.

At any rate, the plausibility and/or the accuracy of the resulting resting position may be checked by comparing it to an expected range of positions for the valve in use (e.g. it may be expected that the resting position will be in the range of from 5% to 15% travel). Additionally or alternatively, the resting position may be compared to previous resting positions, wherein a current resting position may be accepted if it is within a threshold percentage (e.g., within 5%) of a previous resting position.

Turning now to FIG. 8, it shows an embodiment 800 of part of the system 200 of FIG. 2. At 213, a diagnostic factor is calculated for each of the P, I and D terms of the PID controller (e.g., PID controller 210 of FIG. 2). $DF_P$, $DF_I$, and $DF_D$ represent the individual diagnostic factors calculated at 213. At 213, the proportional diagnostic factor $DF_P$ is outputted and at 215*a*, added to the P-term (calculated at 215) to form the adjusted P-term, $P_{adjust}$ at 215*a*, and similarly for the integral and derivative terms.

In one example, each of the proportional diagnostic factor, $DF_P$, the integral diagnostic factor, $DF_I$, and the derivative diagnostic factor, $DF_D$, are selected to be a valve "stickiness factor" determined during the method 400 of FIG. 4. For example, each of $DF_P$, $DF_I$, and $DF_D$ is a function of at least one of $f_1$, $f_2$, $f_3$, $f_4$, $f_5$, as calculated above. Each of the P, I and D terms may therefore be adjusted/corrected by a valve stickiness factor. i.e., $$DF_P=h_1=h_1(f_1, f_2, f_3, f_4, f_5)$$

$$DF_I=h_2=h_2(f_1, f_2, f_3, f_4, f_5)$$

$$DF_D=h_3=h_3(f_1, f_2, f_3, f_4, f_5)$$

In this way, according to the present disclosure, the base PID control parameters (P, I, and D, or p-gain, i-gain and d-gain) may be individually calculated as functions of the actuator position (or the difference in position being equal to the actual position subtracted from the desired position) and are then modified by a correction factor which is a function of the valve stickiness factor. For example, each P, I, D, term may be obtained as the output of a look-up table with the EGR valve stickiness factor as its input. Adjusting the P, I, and D terms may then comprise multiplying or adding the individual terms to the respective correction factors. In other words, the correction factor to add or multiply to the P, I, D terms may be obtained using separate look-up tables with each individual stickiness factor as the input. For example, if the EGR valve stickiness is a high stickiness, then one or more of the p-gain, i-gain, and d-gain may be increased. In one example, this may result in increased power supply to the actuator of the EGR valve to overcome an increased static friction experienced by the EGR valve.

Turning now to FIG. 9, it shows one exemplary calculation of a corrected feed-forward term, that may be added to the (corrected) PID output.

At 910, 911 and 912, corrected values of the breakaway current $I_{break}$ (current being used in this example in place of duty cycle), hang time $t_{hang}$, and valve travel velocity $v_{travel}$ (which may be interchangeably referred to as valve closing speed) are calculated. At 910, the breakaway current correction is calculated as being a function $g_1=g_1(x, I_{break})$ of the travel direction of the EGR valve x at 900 and the breakaway current $I_{break}$ at 901.

Similarly, at 911, the hang time correction is calculated as being a function $g_2=g_2(x, t_{hang})$ of the travel direction of the EGR valve x at 902 and the hang time $t_{hang}$ at 903. At 912, the valve closing speed correction is calculated as being a function $g_3=g_3(x, v_{travel})$ of the travel direction of the EGR valve x at 904 and the closing speed $v_{travel}$ at 905.

At 917 the breakaway current correction, the hang time correction, and the valve closing speed are combined to form a feed-forward adjustment, which can be considered as the diagnostic factor for correcting the feed-forward term. In this example, the diagnostic factor for the feed-forward term, $DF_{FF}$, adjusted at 917, is the sum of the values $g_1$, $g_2$, $g_3$, shown in equation 1 below:

$$DF_{FF}+g_1+g_2+g_3$$

The feed forward diagnostic factor may be added to the original feed-forward signal at 913. These may also be added to an aerodynamic correction 914. The final corrected term is then outputted at 915, this final term being influenced by the diagnostic factor $DF_{\mu F}$.

The feed forward diagnostic factor may, instead or in addition, be multiplied to the original feed forward signal 913.

It may thus be appreciated that the present disclosure provides a PID controller parameter correction, and a feed-forward term correction based on a factor indicative of a condition that may affect the valve's movement, such as contamination of the valve.

The base PID control parameters can be individually calculated as functions of the actuator position deviation with each gain (P, I, D) being adjusted by a correction factor which is based on the engine operating state, aerodynamic, and environmental conditions. Each of the P, I, and D gains may be multiplied by a correction factor which is a function of a "stickiness factor" of the valve. For example, the factor may be obtained as the output of a look-up table with the EGR valve "stickiness factor" as its input. A multiplying term can therefore be calculated for each of the P, I and D gains using separate look-up tables. A correction term could also be calculated which is added to each of the gains.

In this way, controller gains are tuned as a consequence of the measured ageing and contamination of the EGR valve. Thus, for a given error, the gains may be more increased in response to increased measured ageing and/or increased contamination. For the same given error, the gains may be less increased in response to comparatively less increased measured ageing and/or less increased contamination. As such, this may affect adjustments to EGR valve operation to compensate for static friction, sliding friction, return spring ageing, aerodynamics, exhaust flow, and the like.

A base feed-forward signal is also calculated, and may be calculated based on whether the valve is opening or closing and whether it is currently above or below a set point. A correction term is added to this base feed-forward signal to adjust for the engine operating conditions and aerodynamic effects. This can involve adding to the feed-forward signal another term, which, by example only, may be the sum of a breakaway current adjustment, a hanging time adjustment, and a valve closing speed adjustment. As above, the breakaway current adjustment may be a function of the measured breakaway current, and the direction of EGR valve movement (e.g. opening or closing). Similarly, the hanging time adjustment may be a function of measured hanging time and the direction of EGR valve movement; and the valve closing speed adjustment may be a function of the measured valve closing speed and the direction of EGR valve movement.

In each scenario, the adjustment value may be obtained as the output of a separate look-up map with the breakaway current/hanging time/closing speed as its first input and the valve travel direction as its second input. Along with an aerodynamic and an engine operating mode correction this may be added to the base feed-forward term.

Look-up maps can therefore be used to weigh the three measurements according to their relevance to the current motion of the valve.

In one possible arrangement the term which is added to the feed-forward signal is calculated as the sum of adjustments based on the breakaway current, hanging time, and valve speed. Additionally or alternatively, the valve holding current or valve drop time may be used. In another possible arrangement the term can be multiplied to the feed-forward signal.

In this way, the fed-forward term is adjusted as a consequence of the measured dynamics of the EGR valve.

The calculation of the correction factors for the gains of the PID controller and the correction term for the feed-forward term have been exemplified using look-up tables (one input) and maps (two inputs), however other methods of calculation are possible. For example, a polynomial with one or two inputs may be used. In this way, an EGR valve operation may be adjusted in response to an estimated valve stickiness value determined during an EGR valve diagnostic. The valve stickiness may be based on one or more of a breakaway power, a holding power, a hanging time, a valve travel time, and a valve travel speed. The technical effect of adjusting the EGR valve operation at least partially based on the estimated valve stickiness is to decrease a difference and/or an error between a current EGR valve position and a desired EGR valve position.

In another representation an exhaust gas recirculation (EGR) valve control method comprises determining, when the engine is not running, an EGR valve diagnostic factor based on at least one of the power used to move the EGR valve from its mechanical resting positon, the power used to hold the EGR valve open at the specific position, the time, after removal of a holding power to hold the EGR valve at a specific position, before the EGR valve starts to move from that specific position towards its mechanical resting position, the time taken for the EGR valve to move from the specific position to its mechanical resting position, the speed at which the EGR valve travels from the specific position to its mechanical resting position and adjusting the control of the EGR valve when the engine is running based on the EGR valve diagnostic factor.

The control method may further comprise where the EGR valve diagnostic factor may be selected to be at least one of the power used to move the EGR valve from its mechanical resting positon, the power used to hold the EGR valve open at the specific position, the time, after removal of a holding power to hold the EGR valve at a specific position, before the EGR valve starts to move from that specific position towards its mechanical resting position, the time taken for the EGR valve to move from the specific position to its mechanical resting position, and the speed at which the EGR valve travels from the specific position to its mechanical resting position.

The EGR valve control method further comprises where the EGR valve diagnostic factor is selected to be a function of at least one of the power used to move the EGR valve from its mechanical resting positon, the power used to hold the EGR valve open at the specific position, the time, after removal of a holding power to hold the EGR valve at a specific position, before the EGR valve starts to move from that specific position towards its mechanical resting position, the time taken for the EGR valve to move from the specific position to its mechanical resting position, and the speed at which the EGR valve travels from the specific position to its mechanical resting position.

The EGR valve control method further comprises where the function is the output of a look-up table with the variable the power used to move the EGR valve from its mechanical resting positon, the power used to hold the EGR valve open at the specific position, the time, after removal of a holding power to hold the EGR valve at a specific position, before the EGR valve starts to move from that specific position towards its mechanical resting position, the time taken for the EGR valve to move from the specific position to its mechanical resting position, and/or the speed at which the EGR valve travels from the specific position to its mechanical resting position as its input.

The EGR valve control method further comprises where at least one of the functions is a polynomial.

The EGR valve control method further comprises where the EGR valve diagnostic factor is selected to be a function of at least one of the power used to move the EGR valve from its mechanical resting positon, the power used to hold the EGR valve open at the specific position, the time, after removal of a holding power to hold the EGR valve at a specific position, before the EGR valve starts to move from that specific position towards its mechanical resting position, the time taken for the EGR valve to move from the specific position to its mechanical resting position, the speed at which the EGR valve travels from the specific position to its mechanical resting position, and the direction of movement of the EGR valve.

The EGR valve control method further comprises where the function is the output of a look-up table with direction of movement of the EGR valve and the variable the power used to move the EGR valve from its mechanical resting positon, the power used to hold the EGR valve open at the specific position, the time, after removal of a holding power to hold the EGR valve at a specific position, before the EGR valve starts to move from that specific position towards its mechanical resting position, the time taken for the EGR valve to move from the specific position to its mechanical resting position, and/or the speed at which the EGR valve travels from the specific position to its mechanical resting position as its inputs.

The EGR valve control method further comprises where at least one of the functions is a polynomial.

The EGR valve control method further comprises where the EGR valve diagnostic factor is selected to be at least one of the power used to move the EGR valve from its mechanical resting positon, the power used to hold the EGR valve open at the specific position, the time, after removal of a holding power to hold the EGR valve at a specific position, before the EGR valve starts to move from that specific position towards its mechanical resting position, the time taken for the EGR valve to move from the specific position to its mechanical resting position, and the speed at which the EGR valve travels from the specific position to its mechanical resting position.

The EGR valve control method further comprises where the EGR valve diagnostic factor is selected to be a function of at least one of the power used to move the EGR valve from its mechanical resting positon, the power used to hold the EGR valve open at the specific position, the time, after removal of a holding power to hold the EGR valve at a specific position, before the EGR valve starts to move from that specific position towards its mechanical resting position, the time taken for the EGR valve to move from the specific position to its mechanical resting position, and the speed at which the EGR valve travels from the specific position to its mechanical resting position.

The EGR valve control method further comprises where the function is the output of a look-up table with the variable the power used to move the EGR valve from its mechanical resting positon, the power used to hold the EGR valve open at the specific position, the time, after removal of a holding power to hold the EGR valve at a specific position, before the EGR valve starts to move from that specific position towards its mechanical resting position, the time taken for the EGR valve to move from the specific position to its mechanical resting position, and/or the speed at which the EGR valve travels from the specific position to its mechanical resting position as its input. The EGR valve control method further comprises where at least one of the functions is a polynomial.

The EGR valve control method further comprises where the EGR valve diagnostic factor is selected to be the maximum value of the power used to move the EGR valve from its mechanical resting positon, the power used to hold the EGR valve open at the specific position, the time, after removal of a holding power to hold the EGR valve at a specific position, before the EGR valve starts to move from that specific position towards its mechanical resting position, the time taken for the EGR valve to move from the specific position to its mechanical resting position, and the speed at which the EGR valve travels from the specific position to its mechanical resting position.

The EGR valve control method further comprises where the EGR valve is controlled by a PID controller. The EGR valve control method further comprises where adjusting the control of the EGR valve comprises multiplying or adding the output of the PID controller by a first diagnostic factor. The EGR valve control method further comprises where the PID controller has a feed-forward term correction. The EGR valve control method further comprises where adjusting control of the EGR valve comprises multiplying or adding the feed-forward term by a second diagnostic factor.

The EGR valve control method further comprises where the EGR valve is controlled by a PID controller and the output of the PID controller is multiplied by, or added to, a function, this function being a function of at least one of the power used to move the EGR valve from its mechanical resting positon, the power used to hold the EGR valve open at the specific position, the time, after removal of a holding power to hold the EGR valve at a specific position, before the EGR valve starts to move from that specific position towards its mechanical resting position, the time taken for the EGR valve to move from the specific position to its mechanical resting position, and the speed at which the EGR valve travels from the specific position to its mechanical resting position.

The EGR valve control method further comprises where the EGR valve is controlled by a PID controller with a feed-forward term, and the feed-forward term is multiplied by, or added to, a function which is defined as the sum of one or more of the following functions including a function of the power used to move the EGR valve from its mechanical resting positon, and the direction of EGR valve movement, a function of the time, after removal of a holding power to hold the EGR valve at a specific position, before the EGR valve starts to move from that specific position towards its mechanical resting position, and the direction of EGR valve movement and a function of the average speed at which the EGR valve travels from the specific position to its mechanical resting position, and the direction of EGR valve movement.

An embodiment of a method comprises executing an EGR valve diagnostic following an engine deactivation to adjust an EGR valve operation, wherein the EGR valve diagnostic calculates three or more of a breakaway value, a holding power value, a hang time value, a travel time value, and a travel speed value as an EGR valve is actuated from a resting position, to a predetermined position, and back to the resting position. A first example of the method, further includes where the breakaway value is equal to an amount of power used to actuate the EGR valve from the resting position to the predetermined position. A second example of the method, optionally including the first example, further includes where the holding power value is equal to an amount of power used to hold the EGR valve in the predetermined position. A third example of the method, optionally including the first and/or second examples, further includes where the hang time value is calculated in response to power supplied to an actuator of the EGR valve being adjusted to zero when the EGR valve is in the predetermined position, the hang time being equal to a delay from when power supplied to the actuator of EGR valve is adjusted to zero to when the EGR valve begins to move from the predetermined position to the resting position. A fourth example of the method, optionally including one or more of the first through third examples, further includes where the travel distance time is equal to a time used for the EGR valve to travel from the predetermined position to the resting position. A fifth example of the method, optionally including one or more of the first through fourth examples, further includes where the travel speed value is equal to a travel speed of the EGR valve travelling from the predetermined position to the resting position. A sixth example of the method, optionally including one or more of the first through fifth examples, further includes where the resting position is between a fully closed position and a fully open position, and where the resting position comprises where zero power is supplied to an actuator of the EGR valve. A seventh example of the method, optionally including one or more of the first through sixth examples, further includes where the EGR valve operation is adjusted during a subsequent engine activation, and where the EGR valve operation is adjusted to compensate a valve stickiness value equal to a combination of the breakaway value, the holding power value, the hang time value, the travel time value, and the travel speed value.

An example of a system comprises an engine comprising an exhaust-gas recirculation passage fluidly coupling an exhaust passage to an intake passage, wherein exhaust gas from the exhaust-gas recirculation passage to the intake passage is adjusted via an exhaust-gas recirculation valve, and a controller with computer-readable instructions stored on non-transitory memory thereof that when executed enable the controller to execute an exhaust-gas recirculation valve diagnostic in response to an engine being deactivated, wherein the exhaust-gas recirculation valve diagnostic comprises setting a power supply to an actuator of the exhaust-gas recirculation valve to zero, increasing the power supply to the actuator of the exhaust-gas recirculation valve to actuate the exhaust-gas recirculation valve to a predetermined position, calculating a breakaway value equal to the power supply used to actuate the exhaust-gas recirculation valve to the predetermined position, holding the exhaust-gas recirculation valve at the predetermined position, calculating a holding value equal to a holding power supply used to hold the exhaust-gas recirculation valve in the predetermined position, decreasing the holding power supply to zero, measuring a hang time value equal to a time elapsed between decreasing the holding power supply to zero and the exhaust-gas recirculation valve moving out of the predetermined position, calculating a travel time of the exhaust-gas recirculation valve from the predetermined position to a resting position, calculating a travel speed of the exhaust-gas recirculation valve from the predetermined position to the resting position, and combining the breakaway value, the holding value, the hang time value, the travel time, and the travel speed to estimate a stickiness value of the EGR valve, further comprising adjusting an EGR valve operation during a subsequent engine activation based on the stickiness value.

A first example of the system further includes where the instructions further enable the controller to determine one or more of if an exhaust-gas valve position is known, if a battery state of charge is greater than or equal to a threshold state of charge, if an engine operation duration prior to the engine being deactivated was greater than a threshold amount of time, if an end-stop learning was completed, and if a coolant temperature is greater than a threshold temperature prior to the exhaust-gas recirculation valve diagnostic, the end-stop learning comprises learning one or more of a resting position, a fully closed position, and a fully open position of the exhaust-gas recirculation valve, and where the resting position is equal to a position of the exhaust-gas recirculation valve where zero power is supplied to an actuator of the exhaust-gas recirculation valve, wherein the resting position is learned via opening the exhaust-gas recirculation valve via supplying an amount of power to the actuator of the exhaust-gas recirculation valve, decreasing the amount of power to zero, and sensing a valve speed equaling zero, wherein the resting position corresponds to when the valve speed of the exhaust-gas recirculation valve is equal to zero. A second example of the system, optionally including the first example, further includes where the controller is a PID controller with a feed-forward term. A third example of the system, optionally including one or more of the first through second examples, further includes where a p-term, an i-term, and a d-term are adjusted via a diagnostic factor selected from one or more of the breakaway value, the holding value, the hang time value, the travel time, and the travel speed. A fourth example of the system, optionally including one or more of the first through third examples, further includes where the diagnostic factor is equal to an average of one or more of the breakaway value, the holding value, the hang time value, the travel time, and the travel speed. A fifth example of the system, optionally including one or more of the first through fourth examples, further includes where the stickiness value increases in response to one or more of the breakaway value increasing, the holding value increasing, the hang time value increasing, the travel time value increasing, and the travel speed value decreasing, and where a magnitude of adjusting the EGR valve operation increases as the stickiness value increases. A sixth example of the system, optionally including one or more of the first through fifth examples, further includes where the EGR valve operation adjustments include increasing power supply to the EGR valve, wherein the increasing the power supply occurs when the EGR valve is moving in an opening direction, a closing direction, or both.

An embodiment of a method comprises actuating an EGR valve from a resting position to a predetermined position during an engine deactivation, calculating a breakaway power used to actuate the EGR valve from the resting position to the predetermined position, holding the EGR valve in the predetermined position, calculating a holding power used to hold the EGR valve in the predetermined position, and actuating the EGR valve from the predetermined position to the resting position, calculating a hang time for the EGR valve to move out of the predetermine position, calculating a travel time and a travel speed of the EGR valve from the predetermined position to the resting position, and combining the breakaway value, the holding value, the hang time value, the travel time, and the travel speed to estimate a stickiness value of the EGR valve, further comprising adjusting an EGR valve operation during a subsequent engine activation based on the stickiness value. A first example of the method further includes measuring an impact of each of the breakaway value, the holding value, the hang time value, the travel time, and the travel speed on the stickiness value, and where adjusting the EGR valve operation includes adjusting a power supply to an actuator of the EGR valve. A second example of the method, optionally including the first example, further includes adjusting the power supply includes increasing the power supply during an opening of the EGR valve as the impact of the breakaway value increases and increasing the power supply during a stationary position of the EGR valve as the impact of the holding value increases. A third example of the method, optionally including the first and/or second examples, further includes adjusting the EGR valve operation in response to the impact of the hang time value increasing includes advancing a signal to decrease power to the actuator of the EGR valve in response to a desire to move the EGR valve to a more closed position. A fourth example of the method, optionally including one or more of the first through third examples, further includes where stickiness value further comprises a combination of a plurality of averages, each of the averages based on a plurality of breakaway values, a plurality of holding values, a plurality of hang time values, a plurality of travel times, and a plurality of travel speeds.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method comprising:

executing an EGR valve diagnostic following an engine deactivation to adjust an EGR valve operation, wherein the EGR valve diagnostic calculates three or more of a breakaway value, a holding power value, a hang time value, a travel time value, and a travel speed value as an EGR valve is actuated from a resting position, to a predetermined position, and back to the resting position.

2. The method of claim 1, wherein the breakaway value is equal to an amount of power used to actuate the EGR valve from the resting position to the predetermined position.

3. The method of claim 1, wherein the holding power value is equal to an amount of power used to hold the EGR valve in the predetermined position.

4. The method of claim 1, wherein the hang time value is calculated in response to power supplied to an actuator of the EGR valve being adjusted to zero when the EGR valve is in the predetermined position, the hang time being equal to a delay from when power supplied to the actuator of EGR valve is adjusted to zero to when the EGR valve begins to move from the predetermined position to the resting position.

5. The method of claim 1, wherein the travel distance time is equal to a time used for the EGR valve to travel from the predetermined position to the resting position.

6. The method of claim 1, wherein the travel speed value is equal to a travel speed of the EGR valve travelling from the predetermined position to the resting position.

7. The method of claim 1, wherein the resting position is between a fully closed position and a fully open position, and where the resting position comprises where zero power is supplied to an actuator of the EGR valve.

8. The method of claim 1, wherein the EGR valve operation is adjusted during a subsequent engine activation, and where the EGR valve operation is adjusted to compensate a valve stickiness value equal to a combination of the breakaway value, the holding power value, the hang time value, the travel time value, and the travel speed value.

9. A system comprising:

an engine comprising an exhaust-gas recirculation passage fluidly coupling an exhaust passage to an intake passage, wherein exhaust gas from the exhaust-gas recirculation passage to the intake passage is adjusted via an exhaust-gas recirculation valve; and a controller with computer-readable instructions stored on non-transitory memory thereof that when executed enable the controller to:

execute an exhaust-gas recirculation valve diagnostic in response to an engine being deactivated, wherein the exhaust-gas recirculation valve diagnostic comprises:

setting a power supply to an actuator of the exhaust-gas recirculation valve to zero;

increasing the power supply to the actuator of the exhaust-gas recirculation valve to actuate the exhaust-gas recirculation valve to a predetermined position;

calculating a breakaway value equal to the power supply used to actuate the exhaust-gas recirculation valve to the predetermined position;

holding the exhaust-gas recirculation valve at the predetermined position;

calculating a holding value equal to a holding power supply used to hold the exhaust-gas recirculation valve in the predetermined position;

decreasing the holding power supply to zero;

measuring a hang time value equal to a time elapsed between decreasing the holding power supply to zero and the exhaust-gas recirculation valve moving out of the predetermined position;

calculating a travel time of the exhaust-gas recirculation valve from the predetermined position to a resting position;

calculating a travel speed of the exhaust-gas recirculation valve from the predetermined position to the resting position; and combining the breakaway value, the holding value, the hang time value, the travel time, and the travel speed to estimate a stickiness value of the EGR valve, further comprising adjusting an EGR valve operation during a subsequent engine activation based on the stickiness value.

10. The system of claim 9, wherein the instructions further enable the controller to determine one or more of if an exhaust-gas valve position is known, if a battery state of charge is greater than or equal to a threshold state of charge, if an engine operation duration prior to the engine being deactivated was greater than a threshold amount of time, if an end-stop learning was completed, and if a coolant temperature is greater than a threshold temperature prior to the exhaust-gas recirculation valve diagnostic, the end-stop learning comprises learning one or more of a resting position, a fully closed position, and a fully open position of the exhaust-gas recirculation valve, and where the resting position is equal to a position of the exhaust-gas recirculation valve where zero power is supplied to an actuator of the exhaust-gas recirculation valve, wherein the resting position is learned via opening the exhaust-gas recirculation valve via supplying an amount of power to the actuator of the exhaust-gas recirculation valve, decreasing the amount of power to zero, and sensing a valve speed equaling zero, wherein the resting position corresponds to when the valve speed of the exhaust-gas recirculation valve is equal to zero.

11. The system of claim 10, further comprising where the controller is a PID controller with a feed-forward term.

12. The system of claim 11, wherein a p-term, an i-term, and a d-term are adjusted via a diagnostic factor selected from one or more of the breakaway value, the holding value, the hang time value, the travel time, and the travel speed.

13. The system of claim 12, wherein the diagnostic factor is equal to an average of one or more of the breakaway value, the holding value, the hang time value, the travel time, and the travel speed.

14. The system of claim 9, wherein the stickiness value increases in response to one or more of the breakaway value increasing, the holding value increasing, the hang time value increasing, the travel time value increasing, and the travel speed value decreasing, and where a magnitude of adjusting the EGR valve operation increases as the stickiness value increases.

15. The system of claim 14, wherein the EGR valve operation adjustments include increasing power supply to the EGR valve, wherein the increasing the power supply occurs when the EGR valve is moving in an opening direction, a closing direction, or both.

16. A method comprising:

actuating an EGR valve from a resting position to a predetermined position during an engine deactivation;

calculating a breakaway power used to actuate the EGR valve from the resting position to the predetermined position;

holding the EGR valve in the predetermined position;

calculating a holding power used to hold the EGR valve in the predetermined position;

actuating the EGR valve from the predetermined position to the resting position;

calculating a hang time for the EGR valve to move out of the predetermine position;

calculating a travel time and a travel speed of the EGR valve from the predetermined position to the resting position; and combining the breakaway value, the holding value, the hang time value, the travel time, and the travel speed to estimate a stickiness value of the EGR valve, further comprising adjusting an EGR valve operation during a subsequent engine activation based on the stickiness value.

17. The method of claim 16, further comprising measuring an impact of each of the breakaway value, the holding value, the hang time value, the travel time, and the travel speed on the stickiness value, and where adjusting the EGR valve operation includes adjusting a power supply to an actuator of the EGR valve.

18. The method of claim 17, wherein adjusting the power supply includes increasing the power supply during an opening of the EGR valve as the impact of the breakaway value increases and increasing the power supply during a stationary position of the EGR valve as the impact of the holding value increases.

19. The method of claim 17, wherein adjusting the EGR valve operation in response to the impact of the hang time value increasing includes advancing a signal to decrease power to the actuator of the EGR valve in response to a desire to move the EGR valve to a more closed position.

20. The method of claim 16, wherein stickiness value further comprises a combination of a plurality of averages, each of the averages based on a plurality of breakaway values, a plurality of holding values, a plurality of hang time values, a plurality of travel times, and a plurality of travel speeds.

* * * * *